US005794185A

United States Patent [19]

Bergstrom et al.

[11] Patent Number: 5,794,185

[45] Date of Patent: Aug. 11, 1998

[54] METHOD AND APPARATUS FOR SPEECH CODING USING ENSEMBLE STATISTICS

[75] Inventors: Chad Scott Bergstrom, Chandler; Richard James Pattison, Mesa; Carl Steven Gifford, Gilbert, all of Ariz.

[73] Assignee: Motorola, Inc., Schaumburg, Ill.

[21] Appl. No.: 665,178

[22] Filed: Jun. 14, 1996

[51] Int. Cl.[6] ..... G10L 5/00

[52] U.S. Cl. ..... 704/223; 704/219; 704/224; 704/258; 704/264

[58] Field of Search ..... 395/2.32; 704/223, 704/219, 224, 265, 258, 264

[56] References Cited

U.S. PATENT DOCUMENTS

| | | | |
|---|---|---|---|
| 4,850,022 | 7/1989 | Honda et al. | 395/2.16 |
| 4,912,764 | 3/1990 | Hartwell et al. | 395/2.7 |
| 5,195,168 | 3/1993 | Yong | 395/2.29 |
| 5,396,576 | 3/1995 | Miki et al. | 395/2.31 |
| 5,479,559 | 12/1995 | Fette et al. | 395/2.16 |
| 5,579,437 | 11/1996 | Fette et al. | 395/2.71 |
| 5,602,959 | 2/1997 | Bergstrom et al. | 395/2.14 |

*Primary Examiner*—David R. Hudspeth
*Assistant Examiner*—Vijay B. Chawan
*Attorney, Agent, or Firm*—Sherry Whitney

[57] ABSTRACT

A speech coder (100) computes scalar statistics (180), ensemble statistics (190), spectral parameters (150), and a normalized excitation waveform (270) which describe a frame of speech samples. The coder (100) encodes the statistics (220, 230), spectral parameters (155), and the normalized waveform (290) for later decoding and synthesis. A speech synthesizer (900) decodes the encoded scalar statistics (570), encoded ensemble statistics (560), encoded spectral parameters (490), and encoded normalized excitation waveform (550). The synthesizer (900) then denormalizes (670) the normalized excitation waveform using the scalar statistics and the ensemble statistics, resulting in a decoded excitation waveform. Speech is synthesized (710) from the decoded excitation waveform and the decoded spectral parameters.

46 Claims, 23 Drawing Sheets

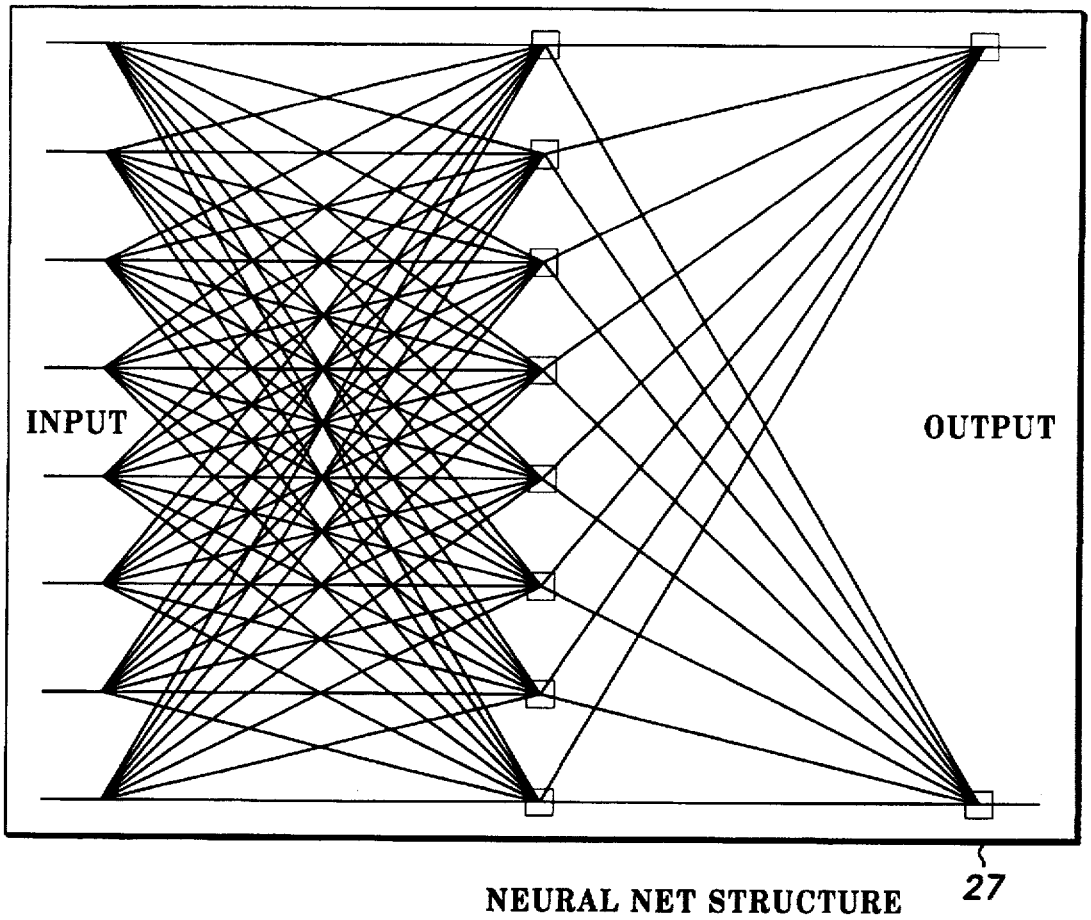
FIG. 3 - PRIOR ART -
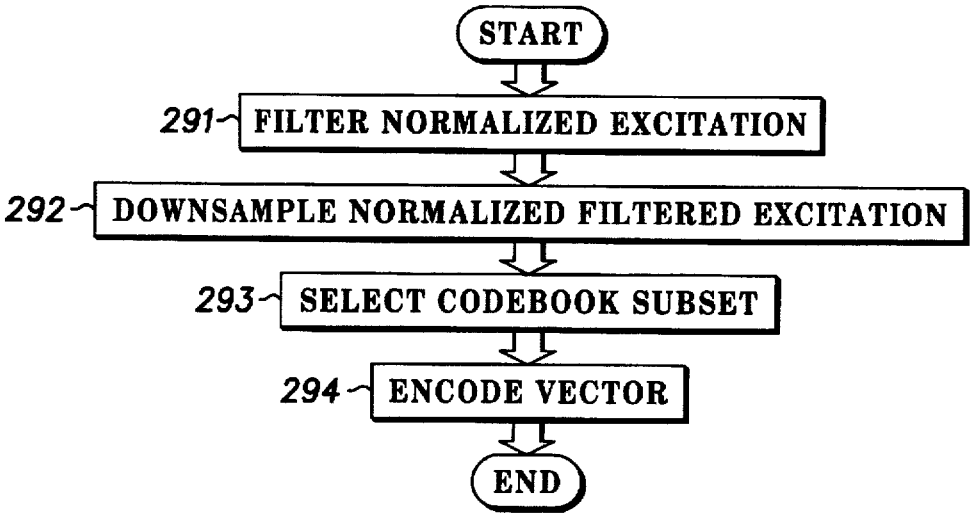
FIG. 23

METHOD AND APPARATUS FOR SPEECH CODING USING ENSEMBLE STATISTICS

CROSS-REFERENCE TO RELATED APPLICATION

This patent application is related to U.S. patent application Ser. No. 08/651,172 entitled "Method and Apparatus for Speech Coding Using Multiple Error Waveforms", filed on May 21, 1996, and assigned to the same assignee as the present invention.

FIELD OF THE INVENTION

The present invention relates generally to human speech compression, and more specifically to human speech compression using ensemble statistics derived from the speech and excitation waveform.

BACKGROUND OF THE INVENTION

Prior-art speech compression techniques use modeling methods that cannot converge to original speech quality regardless of bandwidth or processing effort. Such prior-art methods rely heavily on classification and over-simplified modeling methodologies which neglect the ensemble statistical behavior of the speech waveform, resulting in poor performance and low speech quality.

Prior-art, class-based interpolative speech coding methods cannot converge to perfect speech due to the simplicity of underlying models. Such simple models are unable to capture the fundamental ensemble statistics of the excitation. These simplistic models are subject to a quality plateau, where perceptual speech quality fails to improve regardless of bandwidth or processing effort.

Over-simplified modeling techniques that neglect ensemble statistics introduce significant error in fundamental speech and excitation parameters, causing audible distortion in the synthesized speech waveform. Such algorithms also fail to function properly in the face of classification errors, especially in the presence of interference. Furthermore, prior-art, speech compression techniques often implement fragile, non-robust parameter extraction techniques. These prior-art speech compression methods also are typically inflexible, making it difficult to adapt them to multiple data rates.

What are needed are class insensitive speech compression methods which model ensemble statistics of a speech waveform. What are further needed are robust ensemble statistic parameter extraction techniques and flexible ensemble statistic modeling methods which provide for operation at multiple data rates.

BRIEF DESCRIPTION OF THE DRAWINGS

FIG. 3 illustrates a multi-layer perceptron classifier structure in accordance with a preferred embodiment of the present invention;

FIG. 23 illustrates a method for encoding normalized excitation in accordance with a preferred embodiment of the present invention;

DETAILED DESCRIPTION OF THE DRAWINGS

The method and apparatus of the present invention provide class insensitive speech compression methods which model ensemble statistics of a speech waveform. The method and apparatus of the present invention also provide robust ensemble statistic parameter extraction techniques and flexible ensemble statistic modeling methods which provide for operation at multiple data rates.

As explained previously, prior-art, class-based interpolative speech coding methods cannot converge to perfect speech due to the simplicity of underlying models. Such simple models are unable to capture the fundamental ensemble statistics of the excitation.

A preferred embodiment of the present invention achieves transparent speech output given sufficient bandwidth by means of new ensemble statistic modeling methods which completely describe excitation waveform behavior. The method and apparatus of the present invention incorporate a complete statistical model comprising scalar and ensemble statistics which together form a complete description of the excitation waveform.

Each statistical element is encoded separately. In addition to high-quality, fixed-rate operation, the identity-system capability and low complexity of the present invention make it ideal for use in variable-rate applications. Such applications can be easily derived from a baseline algorithm of a preferred embodiment without changing underlying statistical modeling methods. The present invention provides improvement over prior art methods via convergence to an identity system given sufficient bandwidth, significantly reduced reliance on classification, significantly reduced sensitivity to interference, robust parameter extraction techniques, and simple adaptation to multiple data rates.

Figure 1:
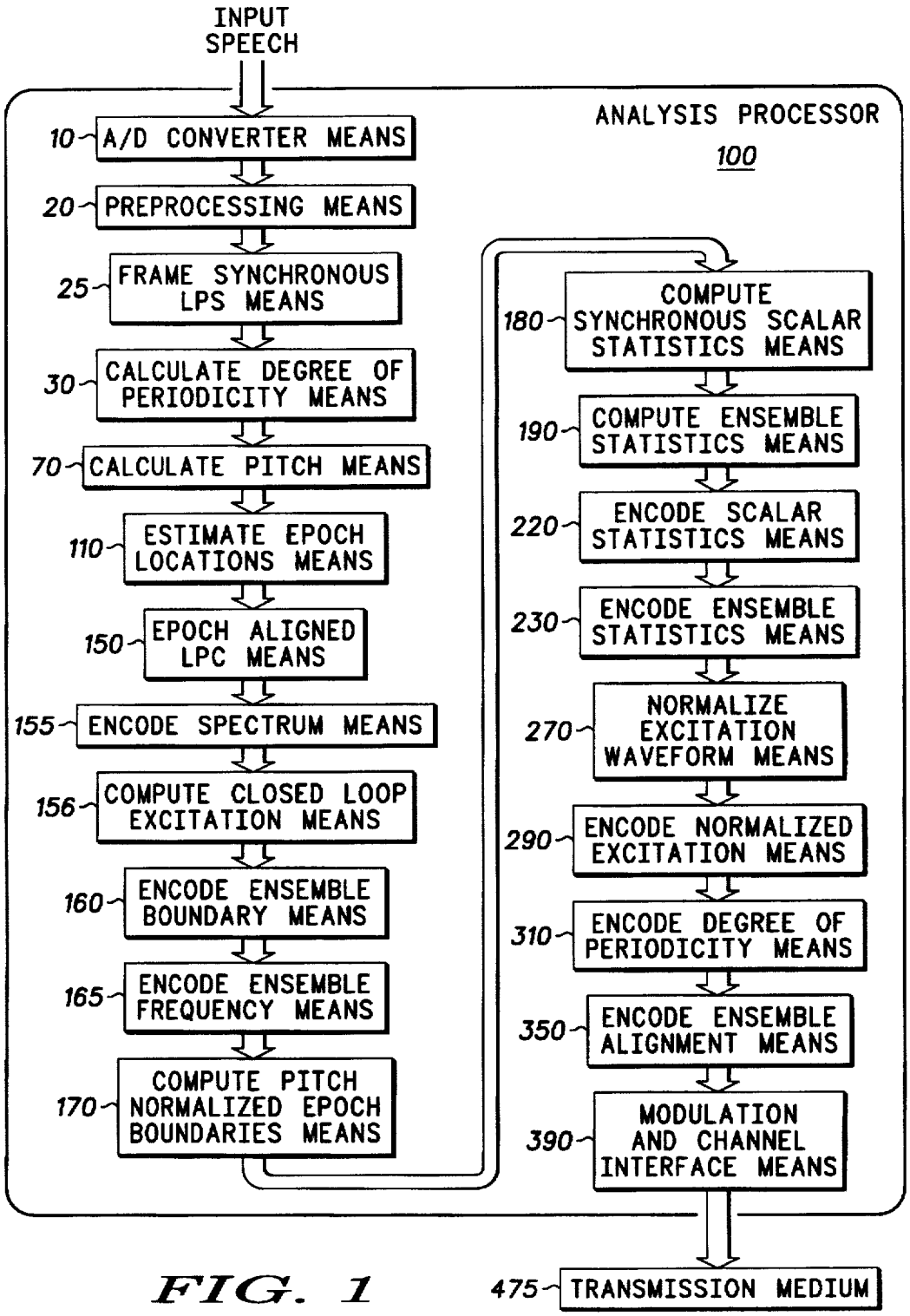
FIG. 1 illustrates a voice coding analysis processor apparatus in accordance with a preferred embodiment of the present invention.

FIG. 1 illustrates voice coding analysis processor apparatus 100 in accordance with a preferred embodiment of the present invention. Analysis Processor 100 is used to encode speech waveforms which are later decoded by Synthesis Processor 900 which is described in conjunction with FIG. 2.

Analysis Processor 100 encodes input speech which originates from a human speaker, or is retrieved from a memory device (not shown). Eventually, the encoded speech is sent to Synthesis Processor 900 (FIG. 2) over Transmission Medium 475 or, alternatively, stored in a memory device (not shown). Channel 475 can be, for example, a hard-wired connection, a Public Switched Telephone Network (PSTN), a radio frequency (RF) link, an optical or optical fiber link, a satellite system, or any combination thereof.

As shown in FIG. 1, speech data is sent in one direction only (i.e., from Analysis Processor 100 to Synthesis Processor 900). This provides "simplex" (i.e., one-way) communication. In an alternate embodiment, "duplex" (i.e., two-way) communication can be provided. For duplex communication, another encoding device (not shown) would be co-located with Synthesis Processor 900. The other encoding device would encode speech data and send the encoded speech data to another decoding device (not shown) co-located with Analysis Processor 100. Thus, terminals that include both an encoding device and a decoding device can both send and receive speech data.

In even another preferred embodiment, Analysis Processor 100 and Synthesis Processor 900 could be co-located in a single device (e.g., a portable recording device) and, rather than sending encoded speech data across transmission medium 475, the encoded speech could be stored in a memory device (not shown) for later decoding.

Referring again to FIG. 1, input speech is first processed by an analog input device (not shown) which converts input speech to an electrical analog signal, which is then converted to a stream of digital samples by A/D Converter Means 10. These samples are operated upon by Pre-processing Means 20, which can perform such steps as high-pass filtering, adaptive filtering, and/or removal of spectral tilt Following Pre-processing Means 20, Frame-Synchronous Linear Predictive Coding (LPC) Means 25 is performed, wherein a "frame" constitutes a segment of input speech corresponding to a specific time interval. Frame Synchronous LPC Means 25 desirably includes LPC analysis and inverse filter operations on the segment of input speech to produce a frame-synchronous excitation waveform corresponding to the segment of speech under analysis. In an alternate embodiment, this first spectral model can be replaced by a somewhat modified algorithm structure which reduces computational complexity.

Frame Synchronous LPC Means 25 is followed by Calculate Degree of Periodicity Means 30, which computes a discrete degree of periodicity for the frame of speech under analysis. In a preferred embodiment, a low-level, multi-layer perceptron (MLP) classifier is used to calculate degree of periodicity and, as will be explained below, to direct codebook selection for the coded parameters.

The neural network MLP classifier is used to direct the algorithm toward either "more random" or "more periodic" codebooks for those parameters that can benefit from classification. Since the MLP classifier primarily directs codebook selection and does not impact the underlying modeling methods, the speech coding algorithm is relatively insensitive to mis-classification.

FIG. 3 illustrates multi-layer perceptron (MLP) classifier structure 27 For exemplary purposes, MLP classifier 27 is a two-layer, ten-perceptron configuration used in a preferred embodiment of the present invention. MLP classifier 27 provides excellent class discrimination, is easily modifiable to support alternate feature sets and speech databases, and provides significantly more consistent results over prior-art, threshold-based methods.

In a preferred embodiment, neural weights are derived in an offline backpropagation process. MLP classifier 27 desirably uses a four element feature vector, normalized to unit variance and zero mean, and implemented on a two-subframe basis to provide a total of eight input features to the neural network. These features are: (1) peak forward-backward subframe autocorrelation coefficient (over the expected pitch range); (2) subframe four pole LPC gain; (3) subframe low-band to high-band energy ratio (lowpass at 1 kHz/highpass at 3 kHz); and (4) ratio of subframe energy to the maximum of N prior periodic subframe energies, where N is a number on the order of 100 for a subframe size of 15 milliseconds (ms).

The calculation of subframe features provides improved discrimination capability at class transition boundaries and further improves performance by providing a simple form of feature context. In addition to the use of subframe features, improved discrimination against "near-silence" conditions is obtained by including a very low level, zero-mean gaussian component prior to feature calculation. This low-level component (e.g., sigma=25.0), biases the features in low-energy conditions and provides for rejection of inaudible sinusoidal signal components that could be interpreted as class periodic.

A preferred embodiment of MLP classifier 27 was trained on a large labeled database in excess of 10,000 speech frames in order to ensure good performance over a wide range of input speech data. Testing using a 5000 frame database outside the training set indicates a consistent accuracy rate of approximately 99.8%.

Figure 4:
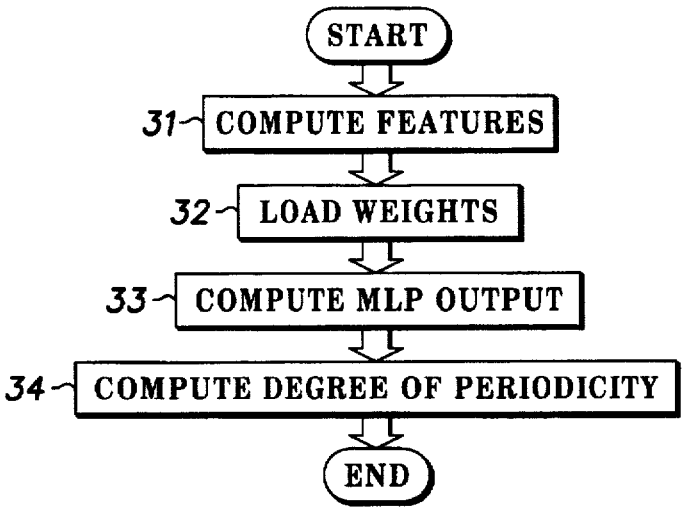
FIG. 4 illustrates a method for calculating the degree of periodicity in accordance with a preferred embodiment of the present invention.

FIG. 4 illustrates a method for calculating the degree of periodicity in accordance with a preferred embodiment of the present invention. The method corresponds to Calculate Degree of Periodicity Means 30 (FIG. 1). The method begins with Compute Features step 31, which computes at least one classifier feature (e.g., the four features enumerated above) which convey the degree of periodicity of the input speech. Compute Features step 31 is followed by Load Weights step 32, which loads the MLP weights from memory which were calculated in the offline backpropagation process in a preferred embodiment. Compute MLP Output step 33 then uses the weights and computed features to compute the output of the MLP. Compute Degree of Periodicity step 34 scalar quantizes the output of Compute MLP Output step 33 to one of multiple degree-of-periodicity levels. The procedure then ends.

Referring again to FIG. 1, Calculate Degree-of-Periodicity Means 30 is followed by Calculate Pitch Means 70. Excitation-based methods for pitch determination have long proven to be unreliable for certain portions of voiced speech, especially for speech that is readily predicted by an all-pole model. In a preferred embodiment of the present invention, a pitch detection technique has been developed which accurately determines pitch directly from the speech waveform, thus eliminating problems associated with prior-art excitation-based pitch detection methods.

An accurate estimate of pitch is computed directly from subframe autocorrelation (e.g., 15 ms subframe segments) of low-pass filtered speech (e.g., 5 pole low pass Chebyshev, 0.1 dB ripple, 1000 Hz cutoff). Consistent pitch estimates are computed using this technique. Half-frame forward and backward subframe correlations are especially useful for onset and offset situations, in that they reduce the random bias introduced by the presence of nonperiodic transition data.

Figure 5:
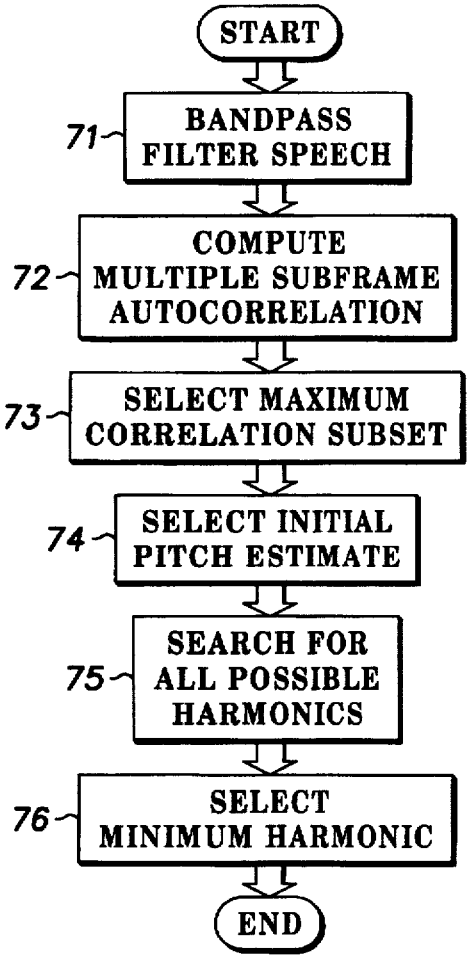
FIG. 5 illustrates a method for calculating pitch in accordance with a preferred embodiment of the present invention.

FIG. 5 illustrates a method for calculating pitch in accordance with a preferred embodiment of the present invention. The method corresponds to Calculate Pitch Means 70 (FIG. 1). The method begins with Bandpass Filter Speech step 71, wherein the input speech frame is filtered, for example, using a bandpass filter with cutoffs at 100 Hz and 1000 Hz. After filtering, Compute Multiple Subframe Autocorrelations step 72 computes a family of correlation sets using multiple subframe segments (e.g., two or more) of the segment of speech under analysis.

Following Compute Multiple Subframe Autocorrelations step 72, Select Maximum Correlation Subset step 73, searches each of the subframe correlation sets and selects the subset encompassing the maximum correlation coefficient $\rho_{max}$. In contrast to problems encountered using excitation for pitch determination, onset and offset speech correlations maintain a useful harmonic pattern, which is augmented by the subframe analysis.

Following the selection of a candidate correlation set from the subframe correlations, an initial pitch estimate is selected in Select Initial Pitch Estimate step 74, within the maximum correlation subset corresponding to the offset lag corresponding to $\rho_{max}$. Given this pitch estimate, Search for All Possible Harmonics step 75 examines the correlation data for evidence of N possible harmonic patterns, each aligned with the maximum positive correlation. Naturally, a limited amplitude and lag variance relative to the peak correlation is tolerated. In a preferred embodiment, candidate harmonics are identified only if: $\rho_i > \rho_{max} * \alpha$, where $\alpha=0.9$.

After all possible harmonic locations corresponding to the initial pitch estimate are identified, Select Minimum Harmonic step 76 sets the pitch equal to the lag corresponding to the minimum identified harmonic location. Pitch contour smoothing can be implemented later, if necessary, as a companion post process. The procedure then ends.

Referring again to FIG. 1, Calculate Pitch Means 70 is followed by Estimate Epoch Locations Means 110. Estimate Epoch Locations Means 110 uses the input speech from Pre-processing Means 20, the frame-synchronous excitation from Frame-Synchronous LPC Means 25, and pitch period determined by Calculate Pitch Means 70 to determine excitation epoch locations, wherein an "epoch" refers to a pitch synchronous segment of excitation corresponding to the pitch period.

In a preferred embodiment, a three-stage epoch position detection algorithm is used, whereby low-pass filtered speech, unfiltered speech, and preliminary excitation waveform are searched in a sequential fashion. The staged approach determines speech epoch indices directly from the filtered and unfiltered speech waveforms, and refines the estimate by using those indices as a mapping into the excitation waveform, where each index is finalized via a localized search. In order to avoid positive/negative peak switching which can occur due to waveform variance, the algorithm first determines a dominant "sense", either positive or negative, and rectifies the waveform to preserve the identified sense.

Figure 6:
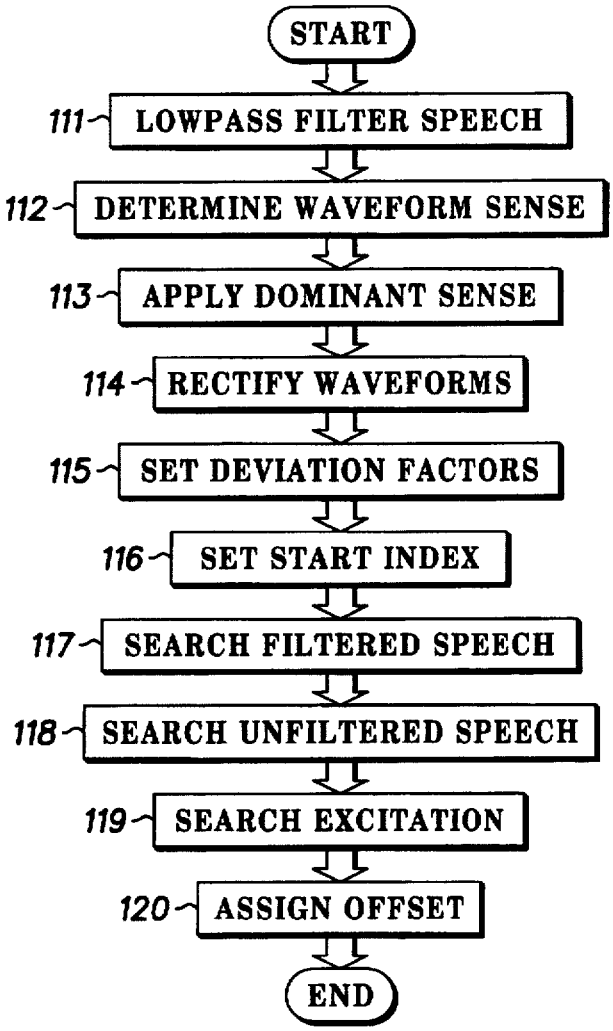
FIG. 6 illustrates a method for estimating epoch locations using a three stage analysis in accordance with a preferred embodiment of the present invention.

FIG. 6 illustrates a method for estimating epoch locations using a three stage analysis in accordance with a preferred embodiment of the present invention. The method corresponds to Estimate Epoch Locations Means 110 (FIG. 1). The method begins with Lowpass Filter Speech step 111, where a lowpass filter is applied to the input speech frame to produce a filtered speech waveform. Lowpass Filter Speech step 111 includes storing the original speech to memory for later reference.

Following Lowpass Filter Speech step 111, Determine Waveform Sense step 112 searches the speech waveform, the lowpass filtered speech waveform, and the excitation waveform for the dominant sense of each waveform, wherein sense refers to the primary sign of the waveforms under analysis. One embodiment of the method searches for the maximum positive or negative extent for each waveform and assigns the sign of the extent to the sense for each waveform.

After Determine Waveform Sense step 112, Apply Dominant Sense step 113 applies the corresponding sense to the excitation waveform, the speech waveform, and the filtered speech waveform (e.g., by multiplying the sense by each waveform). Next, the excitation waveform, speech waveform, and filtered speech waveform are rectified in Rectify Waveforms step 114.

Following rectification, Set Deviation Factors step 115 sets the appropriate pitch search factor for each waveform, where each factor represents the range of pitch period over which waveform peaks are to be determined. For example, the pitch search range factor for filtered speech could be set at 0.5, the search range factor for the speech waveform could be set at 0.3, and the search range factor for the excitation waveform could be set at 0.1. Hence, in a preferred embodiment, the search range of each subsequent stage is narrowed in order to restrict the peak search for that stage. Furthermore, Set Deviation Factors step 115 can take into account the degree-of-periodicity when assigning range factors by restricting the search range for aperiodic data.

After Set Deviation Factors step 115, Set Start Index step 116 sets the starting index for the peak search. A starting index is desirably assigned to be the ending index of the prior frame, minus the frame length. Search Filtered Speech step 117 then searches the filtered speech for peaks at pitch intervals from the starting index over the range of samples determined by the search range factor assigned in Set Deviation Factors step 115, producing indices corresponding to filtered speech peak locations.

Search Unfiltered Speech step 118 uses the indices determined in Search Filtered Speech step 117 as start indices, searching the unfiltered speech for peaks over the range of samples determined by the second search range factor, producing indices corresponding to unfiltered epoch locations. Search Excitation step 119 then uses the indices determined in Search Unfiltered Speech step 118 as start indices, searching the excitation for peaks over the range of samples determined by the third search range factor, producing excitation peak locations.

Following Search Excitation step 119, Assign Offset step 120 applies a desired offset to each of the excitation epoch peak locations (e.g., 0.5* pitch, although other offsets could also be appropriate). Assigning the offsets to each of the excitation peak locations results in the epoch locations. The procedure then ends.

Figure 7:
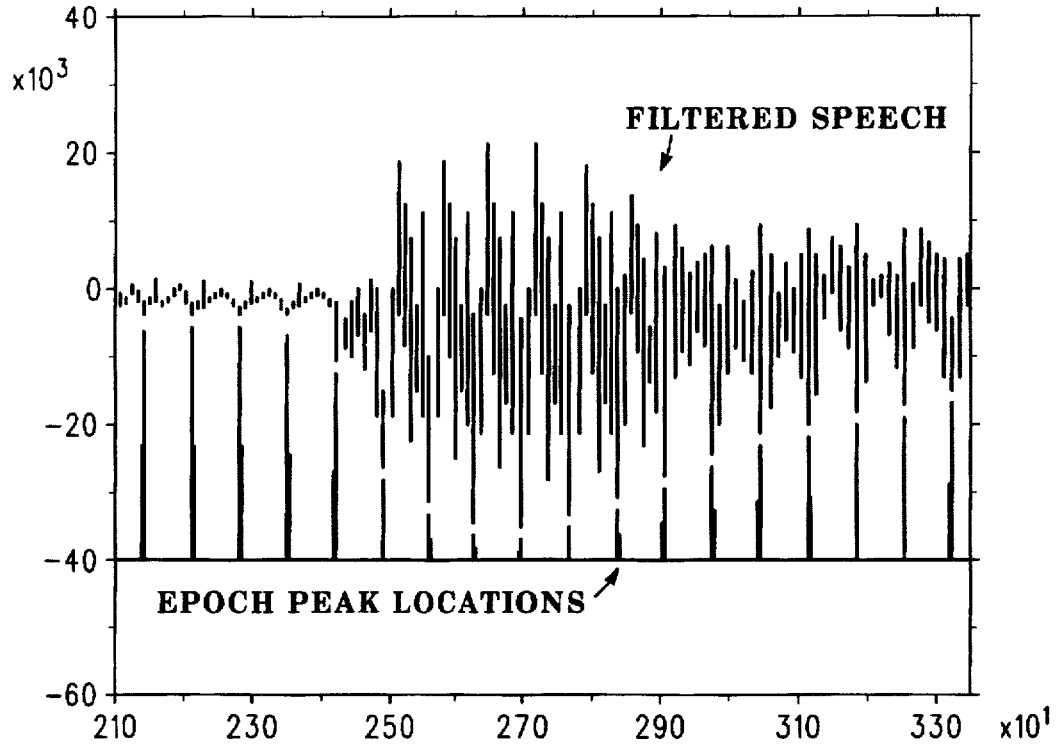
FIG. 7 illustrates exemplary first stage epoch locations determined from filtered speech in accordance with a preferred embodiment of the present invention.
Figure 8:
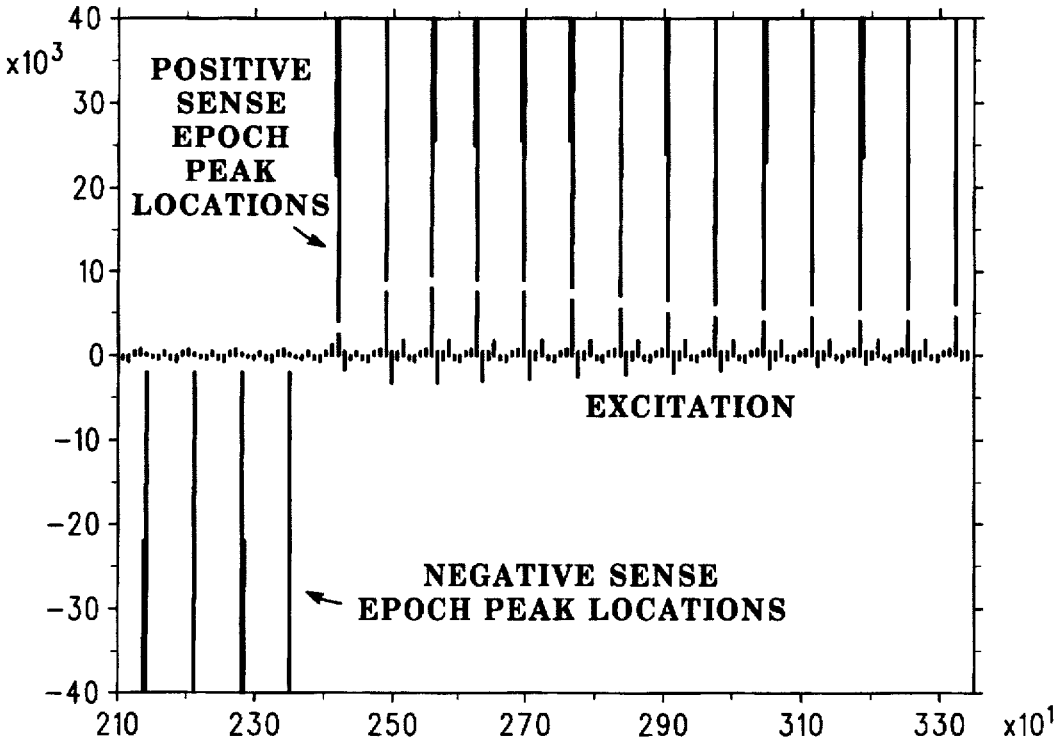
FIG. 8 illustrates exemplary third stage epoch locations determined from the excitation waveform in accordance with a preferred embodiment of the present invention.

FIG. 7 illustrates exemplary first stage epoch locations determined from filtered speech in accordance with a preferred embodiment of the present invention. FIG. 8 illustrates exemplary third stage epoch locations determined from the excitation waveform in accordance with a preferred embodiment of the present invention. FIGS. 7 and 8 illustrate that the staged method works well to provide an accurate index from the filtered speech waveform into the corresponding excitation portion. In addition to epoch locations, Estimate Epoch Locations Means 110 produces an estimate of the number of epochs within the segment under analysis.

Referring again to FIG. 1, following Estimate Epoch Locations Means 110, Epoch Aligned LPC Means 150 uses the estimated epoch locations to compute second LPC parameters corresponding to a segment of speech aligned with the estimated epoch locations. In this manner, the computed excitation statistics correspond directly with the spectral model for the segment of speech under analysis. Epoch Aligned LPC Means 150 sets an analysis window corresponding to the epoch locations for an integer number of epochs, resulting in an epoch-aligned analysis segment, and produces line spectral frequencies corresponding to the segment of speech under analysis, although other representations could also be appropriate (e.g., reflection coefficients).

Following Epoch Aligned LPC Means 150, Encode Spectrum Means 155 encodes the spectral parameters corresponding to the segment of speech under analysis, producing a code index and quantized spectral parameters. Encode Spectrum Means 155 can use vector quantization (VQ) or multi-stage vector quantization (MSVQ) techniques, for example. In a preferred embodiment of the invention, Encode Spectrum Means 155 selects from codebooks corresponding to each of the discrete degrees-of-periodicity produced by Calculate Degree of Periodicity Means 30, although a non-class-based approach could also be appropriate.

Following Encode Spectrum Means 155, Compute Closed-Loop Excitation Means 156 applies an inverse filter described by the quantized spectral parameters computed in Encode Spectrum Means 155 to the epoch-aligned analysis segment to compute a second excitation waveform. In an alternate embodiment, Encode Spectrum Means 155 is not performed between Epoch Aligned LPC Means 150 and Compute Closed Loop Excitation Means 156. In this alternate embodiment, the LPC analysis and inverse filter are performed on the epoch-aligned segment, resulting in the second excitation waveform and prediction coefficients which are encoded later.

Encode Ensemble Boundary Means 160 then encodes the epoch-aligned boundary computed by Estimate Epoch Locations Means 110, producing an integer representing the analysis boundary sample index. Encode Ensemble Frequency Means 165 then scalar quantizes the number of epochs determined in Estimate Epoch Locations Means 110, and produces a code index corresponding to the quantized number of epochs.

Following Encode Ensemble Frequency Means 165, Compute Pitch Normalized Epoch Boundaries Means 170 uses the quantized ensemble boundary from Encode Ensemble Boundary Means 160, and the quantized number of epochs from Encode Ensemble Frequency Means 165, to estimate pitch normalized epoch locations corresponding to locations computed at Synthesis Processor 900 (FIG. 2), producing a sequence of epoch locations with an effective normalized pitch for each epoch to within one sample of the average pitch.

Figure 9:
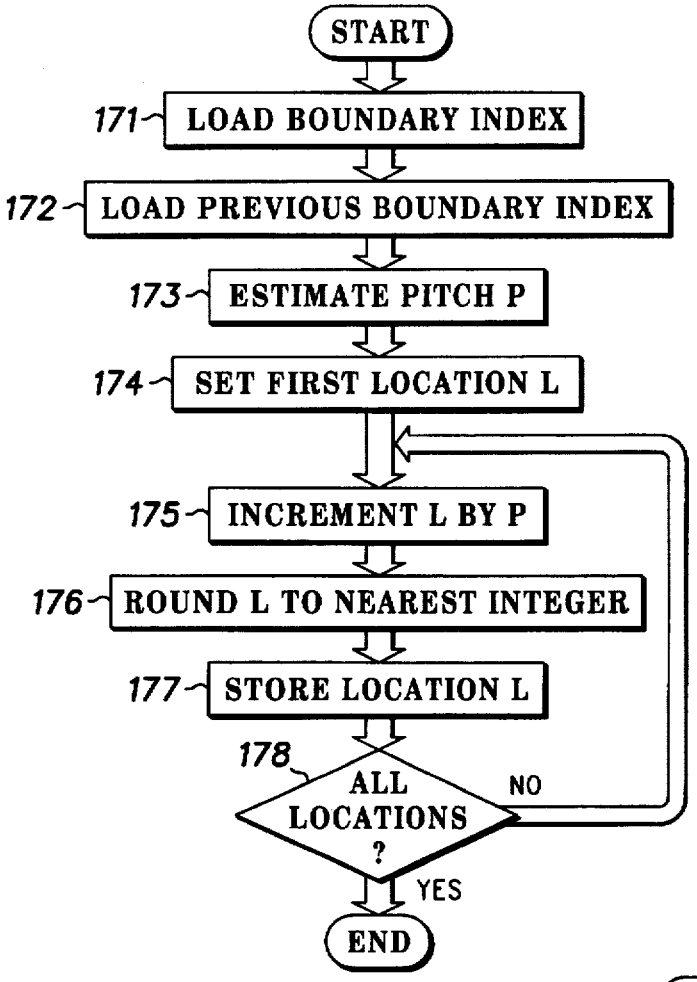
FIG. 9 illustrates a method for computing pitch normalized epoch locations in accordance with a preferred embodiment of the present invention.

FIG. 9 illustrates a method for computing pitch normalized epoch locations in accordance with a preferred embodiment of the present invention. The method corresponds to Compute Pitch Normalized Epoch Boundaries Means 170 (FIG. 1). The method begins with Load Boundary Index step 171, which loads from memory into a buffer, an end boundary index produced by Encode Ensemble Boundary Means 160. The end boundary index corresponds to an ending sample location of the excitation waveform. Load Previous Boundary Index step 172 loads from memory into the buffer, a start boundary index corresponding to the previous boundary, and subtracts the frame length to form an index corresponding to the segment staring boundary of excitation to be statistically modeled. The start boundary index corresponds to a beginning sample location of the excitation waveform.

Estimate Pitch P step 173 then uses the start boundary index from Load Previous Boundary step 172, the end boundary index from Load Boundary Index step 171, and the number of epochs, ne, from Encode Ensemble Frequency Means 165 (FIG. 1), to estimate the normalized pitch, P, using a relation:

P=(end boundary−start boundary)/ne.

Set First Location L step 174 then sets an index pointer, L, to the first boundary. Increment L by P step 175 increments the index pointer by the pitch estimate, P, producing a subsequent index pointer which defines a pitch normalized epoch location estimate. The subsequent index pointer, L, is rounded to the nearest integer to reflect a proper sample index in Round L to Nearest Integer step 176. The rounded index pointer is then stored to memory in Store Location L step 177.

A determination is made, in step 178, whether all locations have been estimated. When all locations have not been estimated, the procedure branches back to Increment L by P step 175. When all locations have been estimated and stored to memory, the procedure ends.

Referring back to FIG. 1, following Compute Pitch Normalized Epoch Boundaries Means 170, Compute Synchronous Scalar Statistics Means 180 computes the scalar statistics for each of the pitch normalized epochs within the analysis segment.

Figure 10:
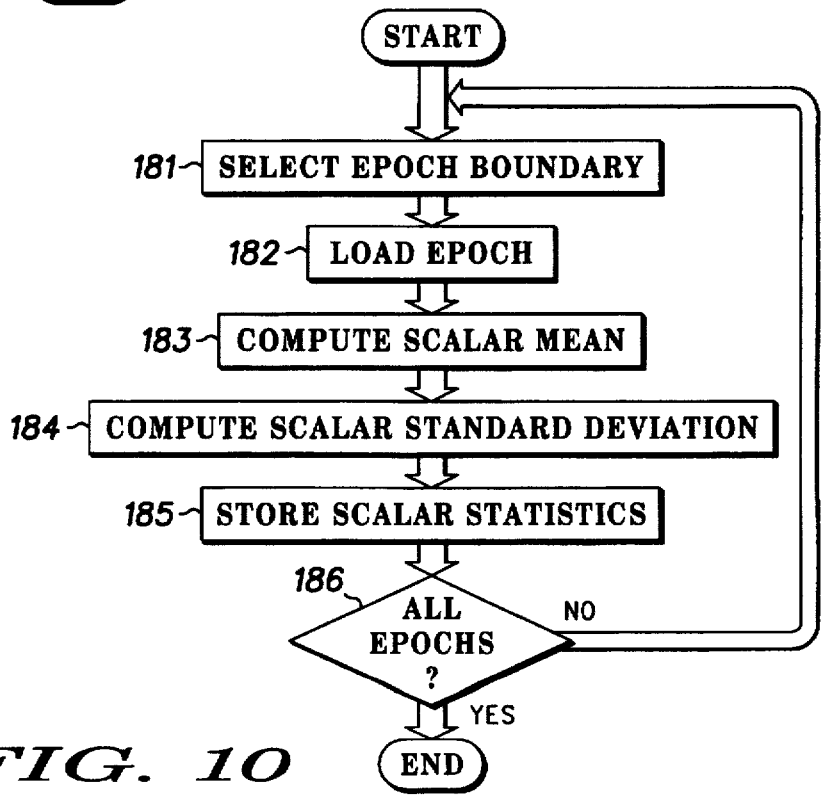
FIG. 10 illustrates a method for computing synchronous scalar statistics in accordance with a preferred embodiment of the present invention.

FIG. 10 illustrates a method for computing synchronous scalar statistics in accordance with a preferred embodiment of the present invention. The method corresponds to Compute Synchronous Scalar Statistics Means 180 (FIG. 1). The method begins with Select Epoch Boundary step 181 which selects a single epoch boundary corresponding to a single epoch, wherein an epoch boundary is selected from the epoch locations produced by Compute Pitch Normalized Epoch Locations Means 170 (FIG. 1). Load Epoch step 182 then loads the segment of excitation corresponding to the epoch boundary into a buffer.

Next, Compute Scalar Mean step 183 computes a mean of the single epoch. Similarly, Compute Scalar Standard Deviation step 184 computes a standard deviation corresponding to the single epoch. The scalar mean and scalar standard deviation, which comprise the scalar statistics for the epoch, are stored to memory in Store Scalar Statistics step 185.

A determination is made, in step 186, whether the scalar statistics of all pitch normalized epochs have been computed and stored. When the scalar statistics of all pitch normalized epochs have not been computed and stored to memory, the procedure branches to Select Epoch Boundary step 181, which sets the epoch segment boundary for the next adjacent excitation segment. When the scalar statistics of all pitch normalized epochs have been computed, the procedure ends.

In an alternate embodiment, the scalar standard deviation vector and scalar mean vector can be scaled by further encoded values which represent the average pitch-normalized epoch standard deviation and average pitch-normalized epoch mean computed over the segment of excitation under analysis.

Referring again to FIG. 1, following Compute Synchronous Scalar Statistics Means 180, the excitation waveform ensemble statistics are computed in Compute Ensemble Statistics Means 190.

Figure 11:
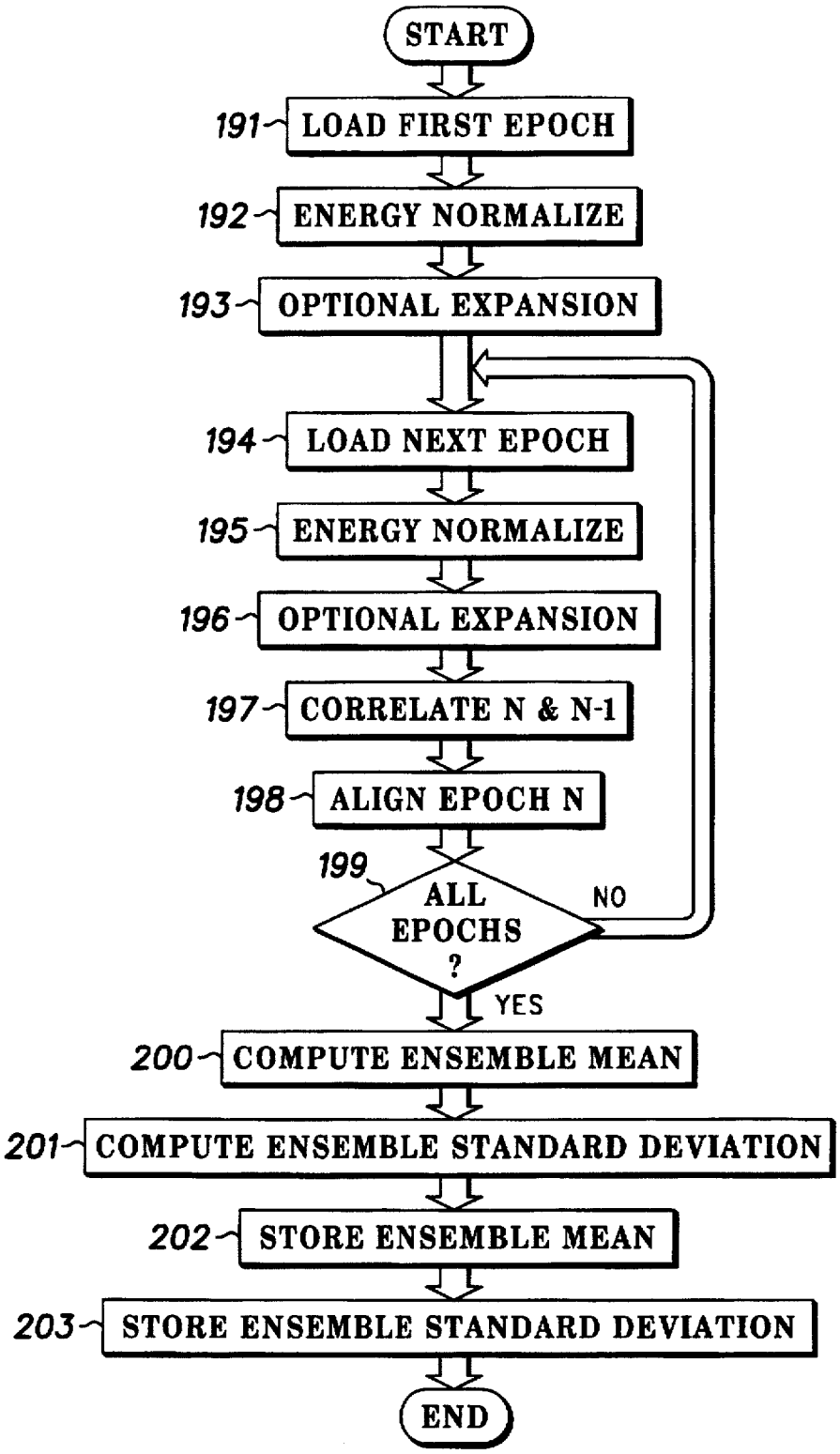
FIG. 11 illustrates a method for computing ensemble statistics in accordance with a preferred embodiment of the present invention.

FIG. 11 illustrates a method for computing ensemble statistics in accordance with a preferred embodiment of the present invention. The method begins with Load First Epoch step 191, wherein the first pitch normalized epoch corresponding to a first epoch boundary within the excitation waveform is loaded into a buffer. Upon execution of a loop defined by steps 194 through 199, this first epoch will be considered a previous epoch. Energy Normalize step 192 next subtracts the scalar mean from the epoch and divides by the scalar standard deviation, producing an energy normalized epoch segment.

In a preferred embodiment, Optional Expansion step 193 then expands the normalized epoch using linear or non-linear interpolation to an arbitrary length for alignment purposes. Upsampling of segments to an arbitrarily large value in this fashion has proven to be of value in epoch-to-epoch alignment and statistic computation, although down-sampling to a smaller length can also be of value. In an alternate embodiment, Optional Expansion step 193 need not be performed.

Load Next Epoch step 194 repeats the procedure of Load First Epoch step 191 for a subsequent epoch which corresponds to a subsequent epoch boundary within the excitation waveform, placing the subsequent epoch into an adjacent location of the buffer. Energy Normalize step 195 then subtracts the epoch scalar mean from the epoch and divides by the epoch scalar standard deviation, producing an energy normalized epoch segment. In a preferred embodiment, the energy normalized epoch segment is then expanded using interpolation methods in Optional Expansion step 196. In an alternate embodiment, Optional Expansion step 196 need not be performed.

Correlate N and N−1 step 197 correlates the subsequent epoch (i.e., epoch N) in the buffer with the previous epoch (i.e., epoch N−1) in the buffer, resulting in an array of correlation coefficients. Align Epoch N step 198 then cyclically shifts epoch N by a lag corresponding to the maximum correlation offset in order to ensemble align epoch N with epoch N−1.

A determination is then made, in step 199, whether all epochs have been aligned. When all epochs have not been aligned, the procedure branches to Load Next Epoch step 194, and repeats the sequence.

When all epochs have been aligned, Compute Ensemble Mean step 200 performs an arithmetic mean operation on the aligned, normalized epochs, producing a vector representing the ensemble mean of the segment of excitation under analysis. Hence, the ensemble mean vector corresponds to the ensemble statistics of approximately a frame length of excitation.

Next, Compute Ensemble Standard Deviation step 201 performs an arithmetic standard deviation calculation on the aligned, normalized epochs, producing a second vector representing the ensemble standard deviation of the segment of excitation under analysis. Hence, the ensemble standard deviation vector corresponds to the ensemble statistics of approximately a frame length of excitation. Following computation of the ensemble statistics, Store Ensemble Mean step 202, and Store Ensemble Standard Deviation step 203 save the statistics to memory prior to encoding. The procedure then ends.

Figure 12:
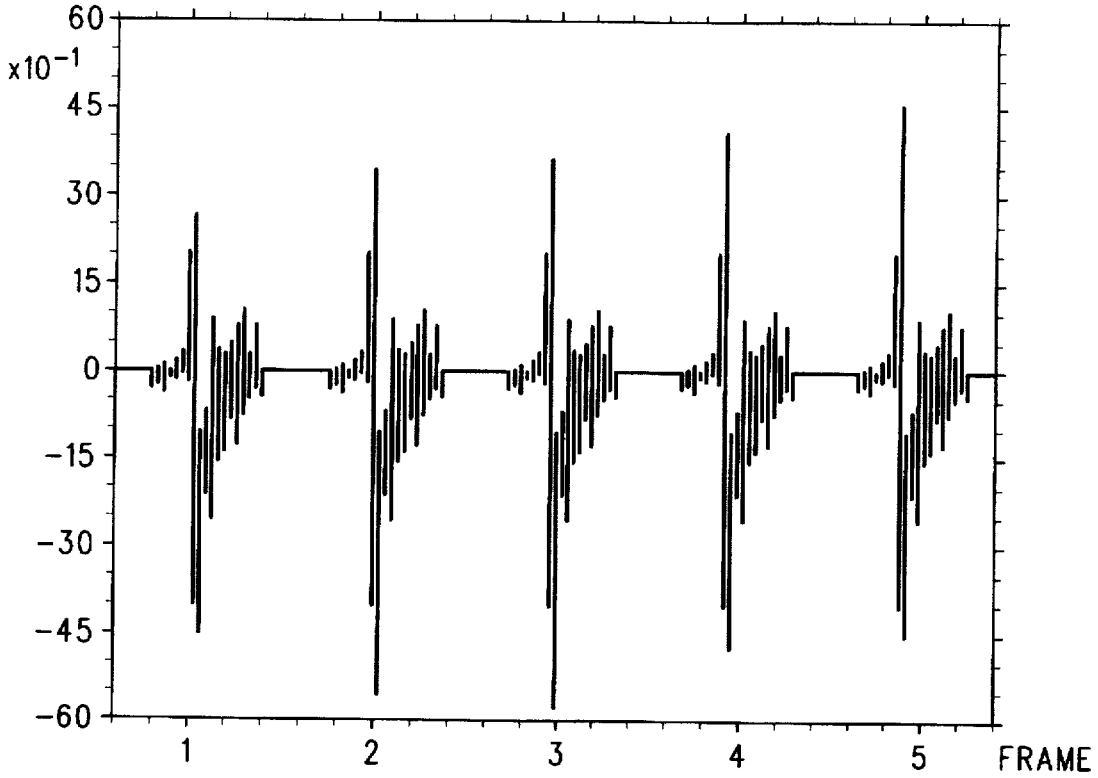
FIG. 12 illustrates exemplary ensemble mean waveforms computed from the excitation waveform in accordance with a preferred embodiment of the present invention.
Figure 13:
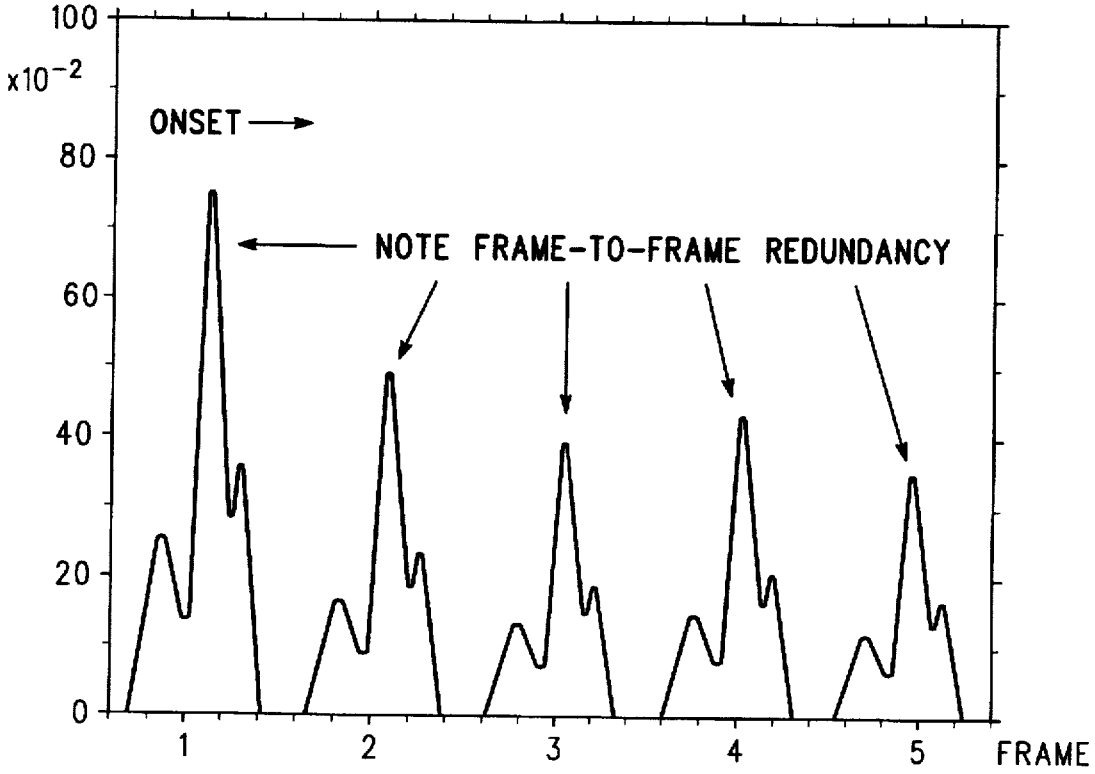
FIG. 13 illustrates exemplary ensemble standard deviation waveforms computed from the excitation waveform in accordance with a preferred embodiment of the present invention.

FIG. 12 illustrates exemplary ensemble mean waveforms computed from the excitation waveform in accordance with a preferred embodiment of the present invention. The sequence of ensemble mean vectors was computed for five consecutive frames of excitation. FIG. 13 illustrates exemplary ensemble standard deviation waveforms computed from the excitation waveform in accordance with a preferred embodiment of the present invention. The sequence of ensemble standard deviation vectors was computed for the corresponding frames. Normalization of the excitation waveform by the ensemble mean of FIG. 12 and the ensemble standard deviation of FIG. 13 provides an excitation sequence which is more readily quantized.

Referring again to FIG. 1, Compute Ensemble Statistics Means 190 is followed by Encode Scalar Statistics Means 220, which produces a code index for each of the scalar statistics computed in Compute Synchronous Scalar Statistics Means 180 (i.e., scalar mean and scalar standard deviation).

Figure 14:
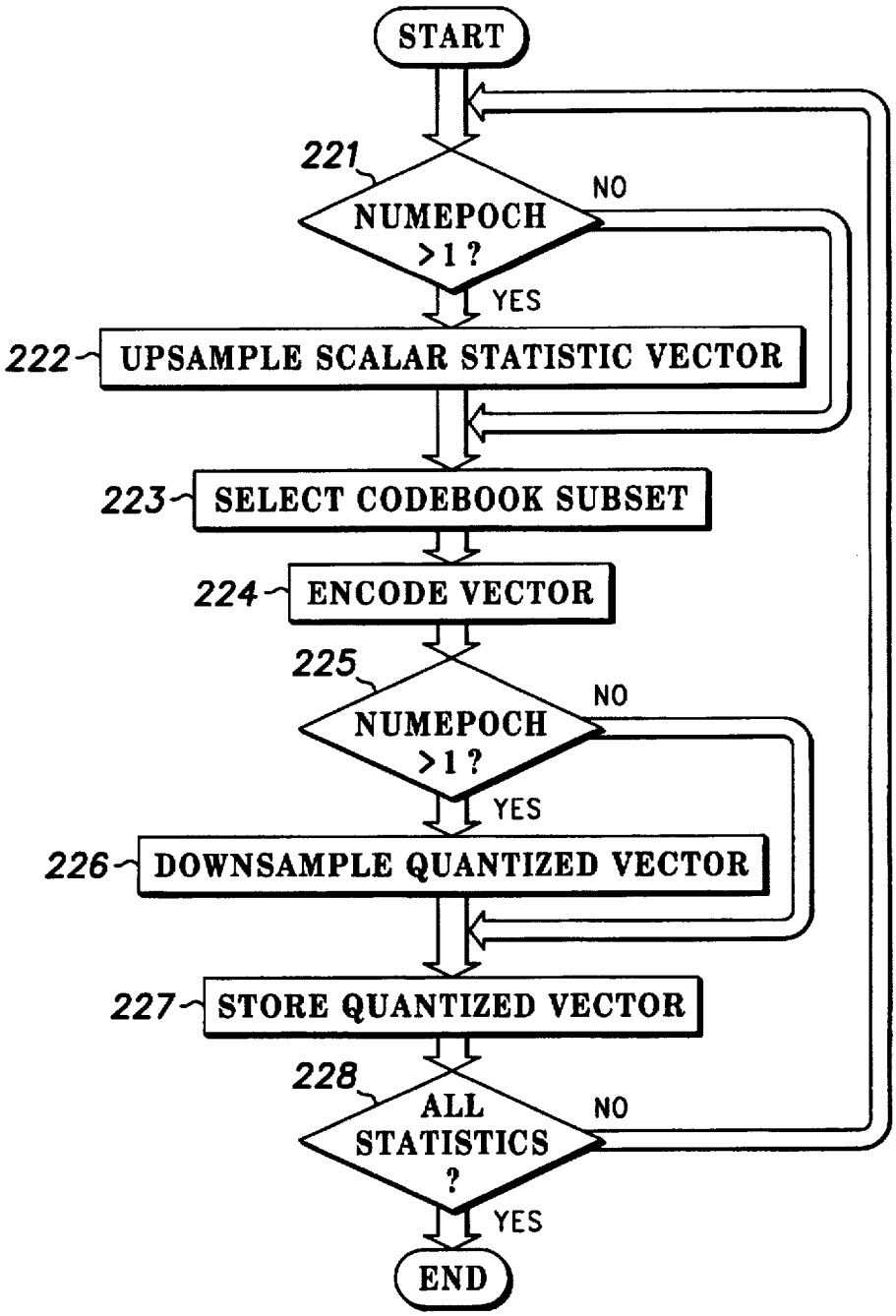
FIG. 14 illustrates a method for encoding scalar statistics in accordance with a preferred embodiment of the present invention.

FIG. 14 illustrates a method for encoding scalar statistics in accordance with a preferred embodiment of the present invention. The method corresponds to Encode Scalar Statistics Means 220 (FIG. 1). The method begins by determining, in step 221, whether Numepoch>1, where Numepoch corresponds to the number of epochs in the current frame under analysis as calculated in Estimate Epoch Locations Means 110 (FIG. 1). When the number of epochs exceeds one, Upsample Scalar Statistic Vector step 222 upsamples the scalar statistic vector to a common vector length, where the scalar statistic vector describes the scalar statistics. In a preferred embodiment of the invention, Upsample Scalar Statistic Vector step 222 upsamples the vector, which initially has Numepoch samples, to a common length equal to the maximum number of epochs allowed per frame (e.g., twelve, although other normalizing lengths could also be appropriate).

After Upsample Scalar Statistics Vector or when the current analysis segment contains not more than one epoch, Select Codebook Subset step 223 is performed, which uses the degree-of-periodicity computed in Calculate Degree of Periodicity Means 30 (FIG. 1) to select a codebook subset which corresponds to the identified class for the speech segment under analysis. For situations where the number of epochs not more than one, the codebook subset can also include a scalar quantizer corresponding to the single scalar statistic value.

Encode Vector step 224 encodes the scalar statistic vector or scalar value using the codebook subset and quantization methods well known to those of skill in the art, such as VQ, split VQ, MSVQ, wavelet VQ, and wavelet TCQ implementations, producing one or more codebook indices and the quantized, scalar statistic vector.

After Encode Vector step 224, a decision is again made, in step 225, whether more than one epoch is represented in the statistic vector, or whether Numepoch>1. When the number of epochs exceeds one, Downsample Quantized Vector step 226 is performed which downsamples the quantized, scalar statistic vector. Downsample Quantized Vector step 226 produces a scalar statistic vector equal to Numepoch samples.

After Downsample Quantized Vector step 226, or when the number of epochs does not exceed one, Store Quantized Vector step 227 stores the quantized scalar statistic vector to memory.

A determination is then made, in step 228, whether all statistics have been encoded. When all statistics have not been encoded, the procedure iterates as shown in FIG. 14. Otherwise, the procedure ends.

Figure 15:
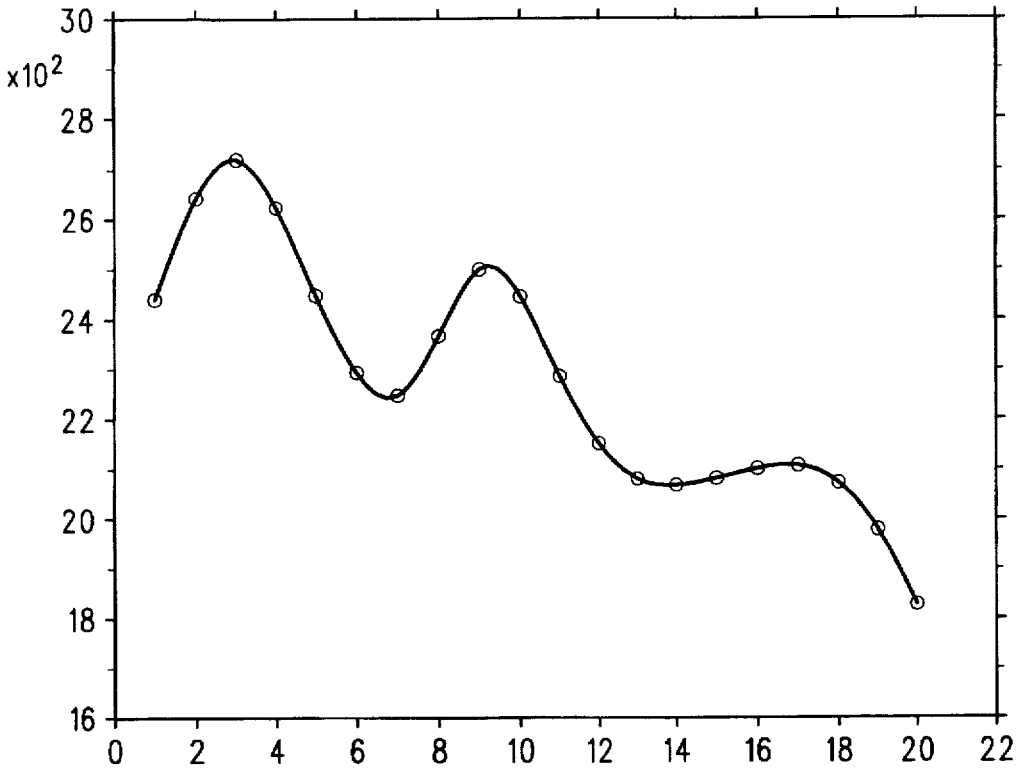
FIG. 15 illustrates an exemplary scalar standard deviation vector computed in accordance with a preferred embodiment of the present invention.
Figure 16:
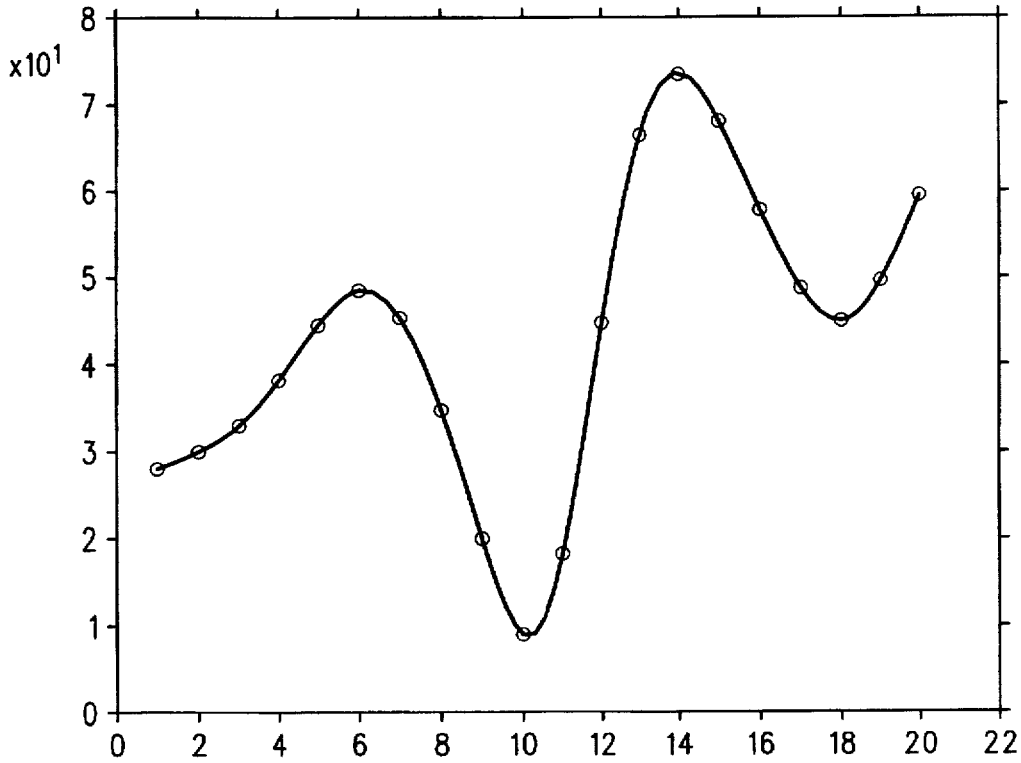
FIG. 16 illustrates an exemplary scalar mean vector computed in accordance with a preferred embodiment of the present invention.

FIG. 15 illustrates an exemplary scalar standard deviation vector computed in accordance with a preferred embodiment of the present invention. FIG. 16 illustrates an exemplary scalar mean vector computed in accordance with a preferred embodiment of the present invention. When used in conjunction with the ensemble mean and ensemble standard deviation, these two vectors provide a further level of excitation normalization.

In an alternate embodiment, prior to encoding, the scalar standard deviation vector and scalar mean vector can be scaled by further encoded values which represent the average epoch standard deviation and average epoch mean computed over the segment of excitation under analysis.

Referring back to FIG. 1, Encode Scalar Statistics Means 220 is followed by Encode Ensemble Statistics Means 230, which encodes the ensemble standard deviation and ensemble mean, producing one or more code indices and the quantized ensemble statistic vector.

Figure 17:
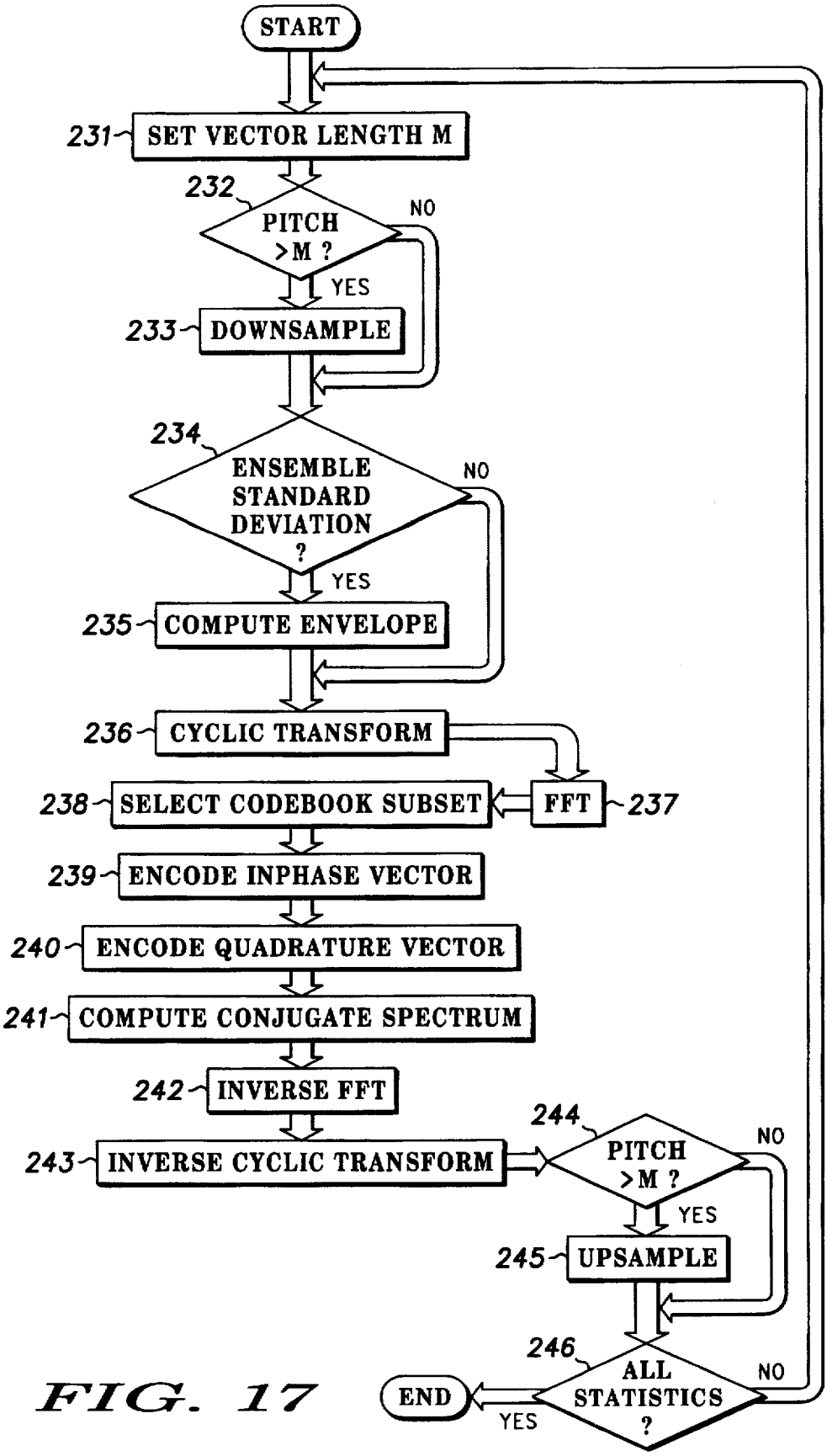
FIG. 17 illustrates a method for encoding ensemble statistics in accordance with a preferred embodiment of the present invention.

FIG. 17 illustrates a method for encoding ensemble statistics in accordance with a preferred embodiment of the present invention. The method corresponds to a frequency-domain implementation of Encode Ensemble Statistics Means 230 (FIG. 1). The method begins with Set Vector Length M step 231, which limits the encoded statistic vector to a maximum of M samples.

A determination is then made, in step 232, whether Pitch>M, or whether the pitch length is greater than M samples, where M corresponds to a Fast Fourier Transform (FFT) size used for characterization of the ensemble statistic (i.e., the characterization vector length), typically a power of two. When the pitch length exceeds the characterization vector length, Downsample step 233 is performed which downsamples the ensemble statistic vector to M samples.

After Downsample step 233 or when the pitch length does not exceed the characterization vector length, a determination is made, in step 234, whether the statistic being encoded is the ensemble standard deviation. If so, Compute Envelope step 235 estimates an envelope of the ensemble standard deviation, producing a correlated, well-behaved vector for encoding. In an alternate embodiment, when the statistic being encoded is the ensemble standard deviation, a filtered version of the ensemble standard deviation can be computed and used as the vector for encoding.

After Compute Envelope step 235 or when the statistic being encoded is not the ensemble standard deviation, Cyclic Transform step 236 is performed which pre-processes the ensemble statistic vector prior to frequency domain transformation in order to minimize frequency domain variance.

Figure 18:
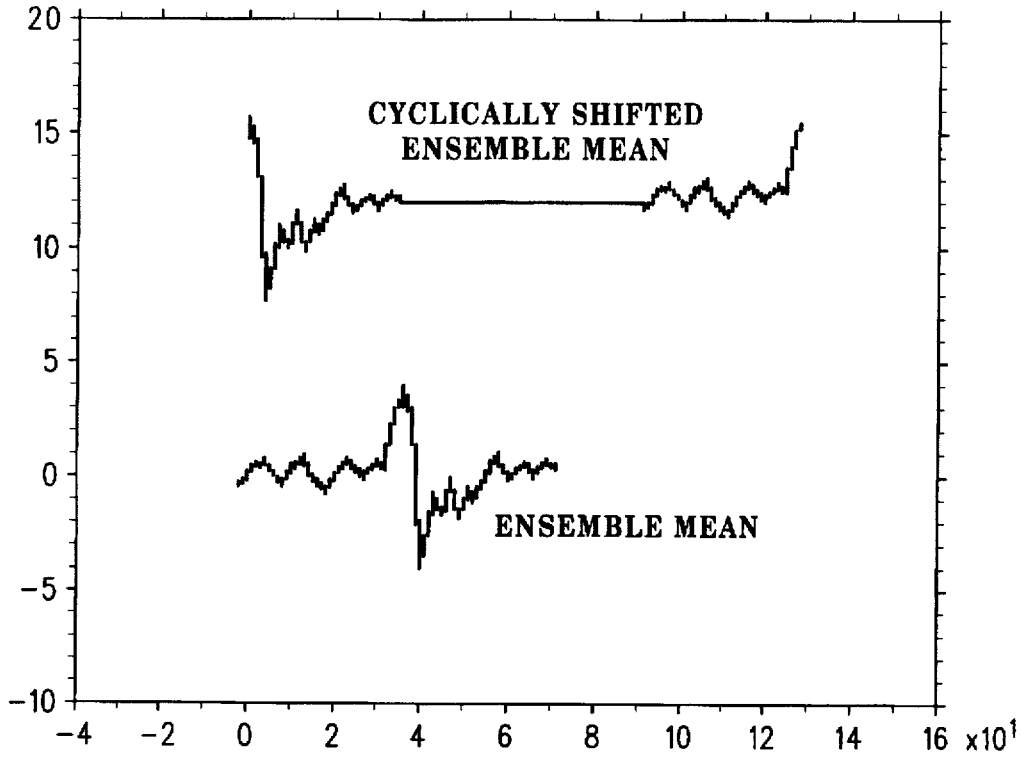
FIG. 18 illustrates an exemplary ensemble mean which has been cyclically shifted in accordance with a preferred embodiment of the present invention.

FIG. 18 illustrates an exemplary ensemble mean which has been cyclically shifted in accordance with a preferred embodiment of the present invention. The cyclic transform for the ensemble mean vector, which cyclically shifted the vector peak to bin zero of the FFT vector, thus placing samples left of the peak at the end of the FFT vector. The variance of the cyclically shifted inphase and quadrature is reduced, which improves quantization performance.

Referring back to FIG. 17, after Compute Envelope step 235 or when the statistic being encoded is the ensemble standard deviation, FFT step 237 then performs an M point FFT on the vector produced by Cyclic Transform step 236, resulting in a frequency-domain representation desirably comprising inphase and quadrature frequency domain vectors. Although an FFT is used to perform a time-domain to frequency-domain transformation, other algorithms which perform the same function could be used in alternate embodiments. This is true for each FFT steps described herein. Following FFT step 237, Select Codebook Subset step 238 uses the degree of periodicity calculated by Calculate Degree of Periodicity Means 30 (FIG. 1) to select a codebook subset corresponding to the identified class.

Next, the frequency-domain representation is encoded, resulting in codebook indices and a quantized frequency domain representation. In a preferred embodiment, this entails steps 239 and 240. Encode Inphase Vector step 239 quantizes at most M/2+1 samples of the inphase data using appropriate quantization methods such as VQ, split VQ, MSVQ, wavelet VQ, or wavelet TCQ quantizers, producing at least one codebook index and a quantized inphase vector. Encode Inphase Vector step 239 can also perform linear or nonlinear downsampling on the inphase vector in order to increase the bandwidth-per-sample.

Encode Quadrature Vector step 240 then quantizes at most M/2+1 samples of the quadrature data using appropriate quantization methods such as VQ, split VQ, MSVQ, wavelet VQ, or wavelet TCQ quantizers, producing at least one codebook index and a quantized quadrature vector. Encode Quadrature Vector step 240 can also perform linear or nonlinear downsampling on the quadrature vector in order to increase the bandwidth-per-sample.

Following Encode Quadrature Vector step 240, Compute Conjugate Spectrum step 241 uses the quantized inphase vector and quantized quadrature vector to produce a conjugate FFT spectrum. The reconstructed inphase and quadrature vectors are then used in Inverse FFT step 242 to produce a quantized, energy-normalized, cyclically-shifted, time-domain ensemble statistic vector. Although an inverse FFT is used to perform a frequency-domain to time-domain transformation, other algorithms which perform the same function could be used in alternate embodiments. This is true wherever an inverse FFT step is performed as described in this Description. Next, Inverse Cyclic Transform step 243 performs an inverse cyclic shift to return the vector to its original position.

A determination is then made, in step 244, whether Pitch>M, or whether the actual ensemble statistic length exceeds the FFT size M. If so, Upsample step 245 is performed which upsamples the ensemble statistic vector to the original vector length, producing a quantized ensemble statistic vector.

After Upsample step 245, or when the actual ensemble statistic length does not exceed the FFT size M, a determination is made, in step 246 whether all statistics have been encoded. If not, the procedure branches to Set Vector Length M step 231, and the procedure repeats. If so, the procedure ends. While the illustrated embodiment of Encode Ensemble Statistics Means 230 encodes inphase and quadrature vectors, alternate embodiments could also be appropriate which use different representations, such as magnitude and phase representations.

Figure 19:
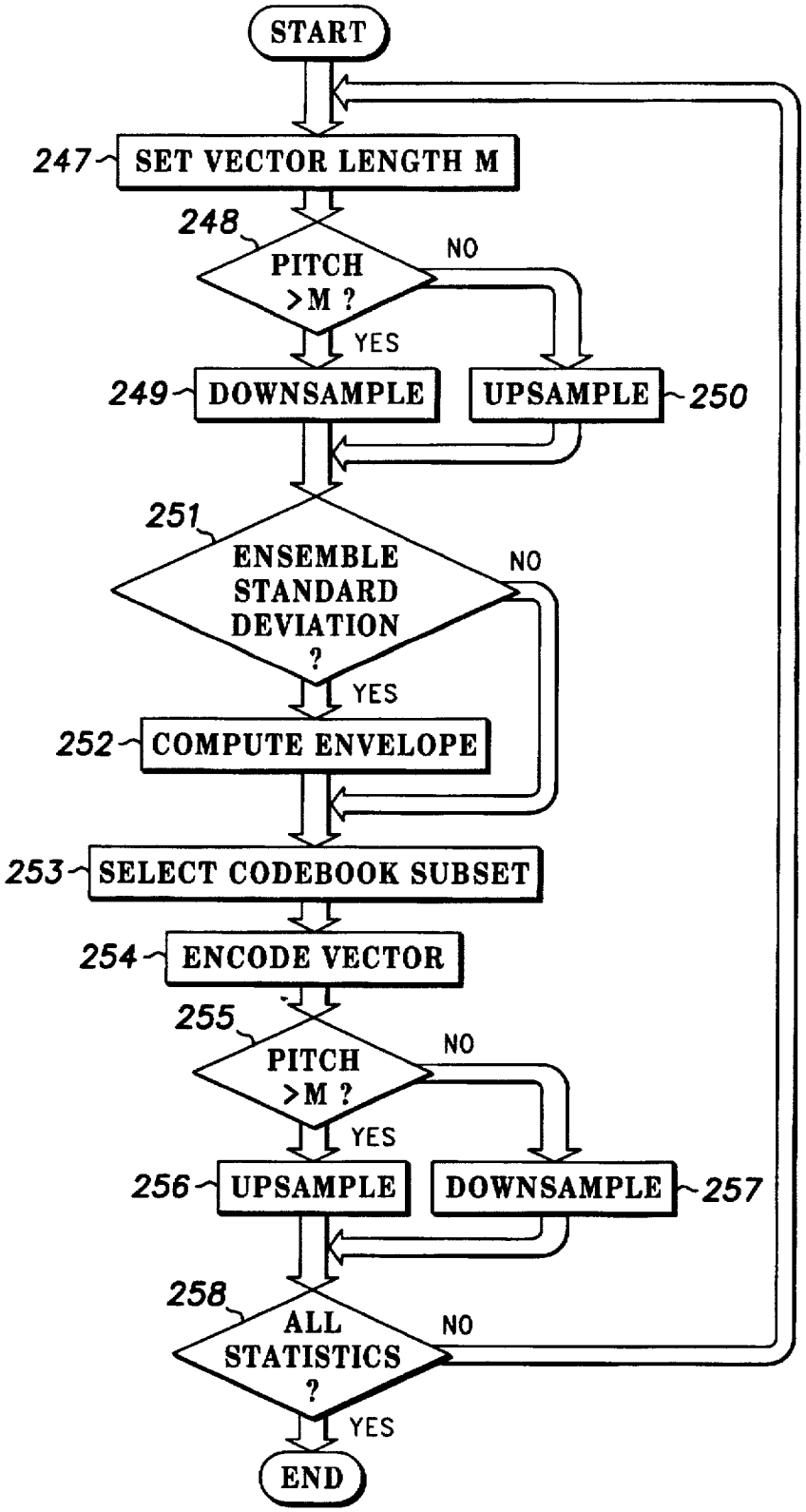
FIG. 19 illustrates a method for encoding ensemble statistics.

FIG. 19 illustrates a method for encoding ensemble statistics in accordance with an alternate embodiment of the present invention. The method corresponds to Encode Ensemble Statistics Means 230 (FIG. 1). The alternate embodiment uses a time domain encoding method rather than a frequency-domain encoding method as was described in conjunction with FIG. 18. The method begins with Set Vector Length M step 247, which reads from memory a fixed characterization vector length M.

A determination is then made, in step 248, whether Pitch>M, or whether the pitch exceeds the characterization vector length M. When the pitch exceeds the vector length M, Downsample step 249 is performed, which decimates the ensemble statistic vector using linear or nonlinear methods. When the pitch is less than the vector length M, Upsample step 250 is performed, which interpolates the ensemble statistic vector using linear or nonlinear methods.

A determination is then made, in step 251, whether the ensemble statistic vector being encoded is the ensemble standard deviation. If so, Compute Envelope step 252 is performed, which estimates an envelope of the ensemble standard deviation, producing a correlated, well-behaved vector for encoding. In an alternate embodiment, when the statistic being encoded is the ensemble standard deviation, a filtered version of the ensemble standard deviation can be computed and used as the vector for encoding.

After Compute Envelope step 252, or when the statistic being encoded is not the ensemble standard deviation, Select Codebook Subset step 253 is performed which uses the degree of periodicity from Calculate Degree of Periodicity Means 30 (FIG. 1) to select a codebook subset corresponding to the identified class.

Encode Vector step 254 then uses the codebook subset and appropriate quantization methods to encode the length-normalized, time domain ensemble statistic vector. Those methods include VQ, split VQ, MSVQ, wavelet VQ, or wavelet TCQ quantizers. The Encode Vector step 254 produces at least one codebook index and a quantized, length-normalized ensemble statistic vector.

In order to reconstruct a quantized ensemble statistic vector, a determination is made, in step 255, whether Pitch>M, or whether the pitch exceeds the characterization vector length M. When the pitch is less than the characterization vector length M, Downsample step 257 is performed which produces a quantized ensemble statistic vector of the proper pitch length by decimating the quantized ensemble statistic vector using linear or nonlinear methods. When the pitch exceeds the characterization vector length M, Upsample step 256 is performed, which produces a quantized ensemble statistic vector of the proper pitch length by interpolating the quantized ensemble statistic vector using linear or nonlinear methods.

Following reconstruction of a quantized ensemble statistic vector, a determination is made, in step 258, whether all statistics have been encoded. If not, the procedure branches back to Set Vector Length M step 247, and the procedure repeats. If all statistics have been encoded, the procedure ends.

Referring again to FIG. 1, Encode Ensemble Statistics Means 230 is followed by Normalize Excitation Waveform Means 270. In order to recover some of the waveform characteristics lost in the spectrum and statistic quantization process, a closed-loop approach is incorporated in a preferred embodiment of the present invention, although an open loop process could also be used in an alternate embodiment. In this manner, the excitation waveform is normalized using quantized scalar and ensemble statistics.

Closed loop quantization requires a staged process, whereby quantized spectrum is used to generate an excitation waveform and subsequent scalar and ensemble statistics. Quantized statistics are subsequently used to develop quantizers for the normalized excitation waveform. Proper quantization of the normalized excitation waveform will recover at least some of the characteristics lost in quantization of the spectrum, scalar statistics, and ensemble statistics.

Figure 20:
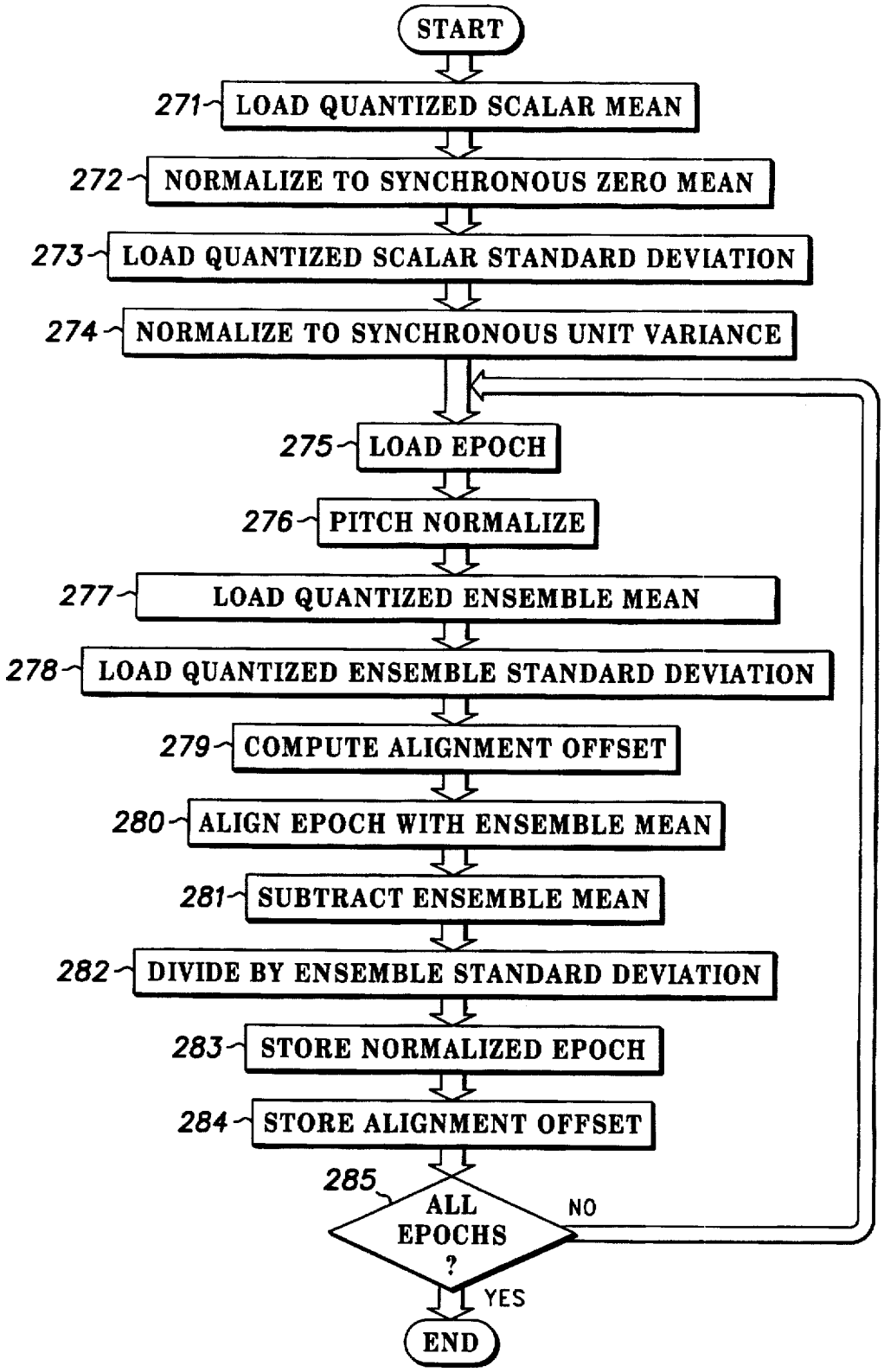
FIG. 20 illustrates a method for normalizing an excitation waveform in accordance with a preferred embodiment of the present invention.

FIG. 20 illustrates a method for normalizing an excitation waveform in accordance with a preferred embodiment of the present invention. The method corresponds to Normalize Excitation Waveform 270 (FIG. 1). The method begins with Load Quantized Scalar Mean step 271, which reads the quantized scalar mean vector generated in Encode Scalar Statistics Means 220 (FIG. 1). For each epoch in the excitation segment under analysis (which was computed in Compute Closed Loop Excitation Means 156, FIG. 1), Normalize to Synchronous Zero Mean step 272 then normalizes the excitation segment by subtracting the appropriate quantized scalar mean value of the vector, producing a sequence of approximately zero mean contiguous epochs.

Next, Load Quantized Scalar Standard Deviation step 273 reads the quantized scalar standard deviation vector generated in Encode Scalar Statistics Means 220 (FIG. 1). For each zero mean epoch produced by Normalize to Synchronous Zero Mean step 272, Normalize to Synchronous Unit Variance step 274 normalizes each zero mean epoch by dividing by the appropriate quantized scalar standard deviation value of the vector, producing a sequence of approximately zero mean and approximately unit variance contiguous epochs.

A first zero mean, unit variance epoch is then loaded into a buffer in Load Epoch step 275. Pitch Normalize step 276 then upsamples or downsamples the epoch. Although the effective "local" pitch length (i.e., the pitch for the current frame) is already normalized to within one sample from Estimate Epoch Locations Means 110 (FIG. 1), Pitch Normalize step 276 can upsample or downsample the segment to a second "global" normalizing length (i.e., a common pitch length for all frames), producing a unit variance, zero mean vector with a normalized length. Upsampling of segments to an arbitrarily large value in this fashion has proven to be of value in epoch-to-epoch alignment, although downsampling to a smaller length can also be of value. In an alternate embodiment, Pitch Normalize step 276 need not be performed.

After Pitch Normalize step 276, the ensemble mean and ensemble standard deviation which were computed by Encode Ensemble Statistics Means 230 (FIG. 1) are read in from memory in Load Quantized Ensemble Mean step 277 and Load Quantized Ensemble Standard Deviation step 278. Load Quantized Ensemble Mean step 277 and Load Quantized Ensemble Standard Deviation step 278 can also include steps of pitch normalization (i.e., upsampling the quantized ensemble mean and the quantized ensemble standard deviation) corresponding to optional Pitch Normalize step 276.

Next, the unit variance, zero mean, normalized epoch is correlated against the quantized ensemble mean in Compute Alignment Offset step 279. Compute Alignment Offset step 279 produces an optimal alignment offset which is used by Align Epoch With Ensemble Mean step 280 to cyclically shift the current epoch in order to maximize ensemble correlation with the ensemble mean, producing a zero-mean, unit- variance, pitch-normalized, shifted epoch (i.e., an aligned epoch).

In order to normalize the excitation epoch, Subtract Ensemble Mean step 281 first subtracts the quantized ensemble mean vector from the aligned epoch, producing a zero ensemble mean epoch. Next, the epoch normalization is completed by Divide by Ensemble Standard Deviation step 282, which divides the zero ensemble mean epoch by the quantized ensemble standard deviation, producing an ensemble zero mean, ensemble unit variance epoch (i.e., a normalized epoch). Store Normalized Epoch step 283 then stores the normalized epoch segment to memory for later encoding. Similarly, Store Alignment Offset step 284 stores the epoch alignment offset computed in Compute Alignment Offset step 279 to memory for later characterization and encoding.

Figure 21:
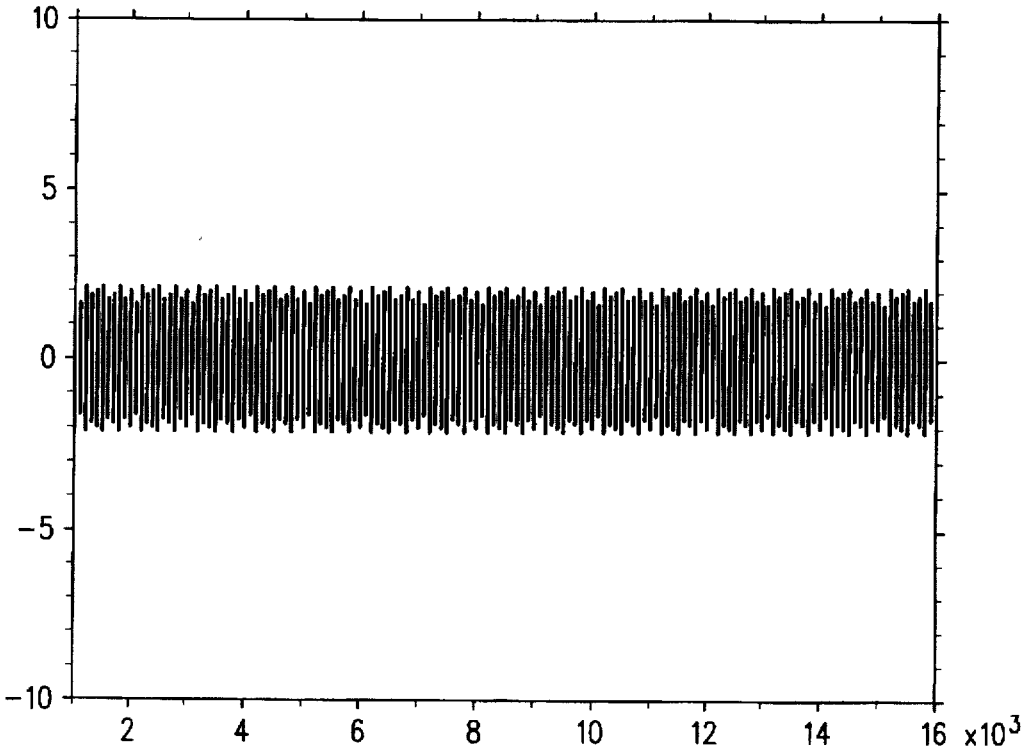
FIG. 21 illustrates an exemplary normalized excitation waveform derived from scalar statistics and ensemble statistics in accordance with a preferred embodiment of the present invention.
Figure 22:
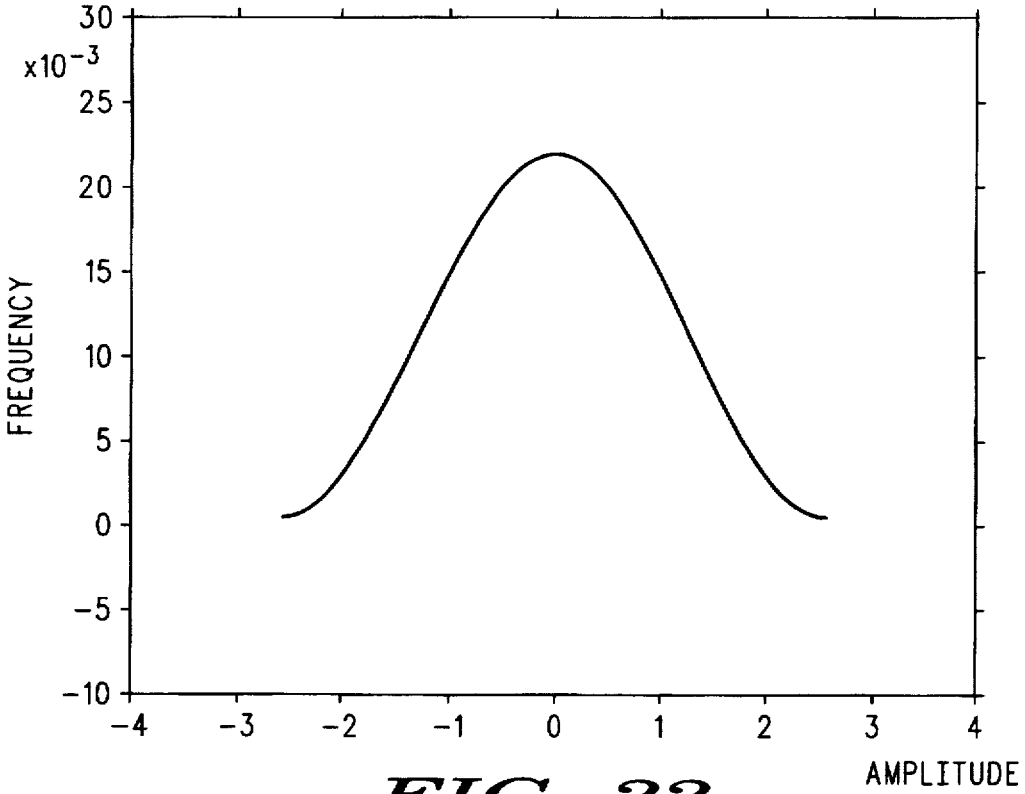
FIG. 22 illustrates an exemplary filtered distribution of a normalized excitation waveform computed in accordance with a preferred embodiment of the present invention.

A determination is made, in step 285, whether all epochs in the analysis segment have been normalized. If not, the procedure branches to Load Epoch step 275, and the process repeats for consecutive epochs in the analysis segment. When all epochs in the analysis segment have been normalized, the procedure ends FIG. 21 illustrates an exemplary normalized excitation waveform derived from scalar statistics and ensemble statistics in accordance with a preferred embodiment of the present invention. Ensemble decorrelation has reduced the inherent information content of the normalized excitation waveform, thus simplifying the encoding task. FIG. 22 illustrates an exemplary filtered distribution of a normalized excitation waveform computed in accordance with a preferred embodiment of the present invention. The filtered distribution is the corresponding data histogram to the waveform of FIG. 21 and displays gaussian properties.

Referring again to FIG. 1, following Normalize Excitation Waveform Means 270, Encode Normalize Excitation Means 290 characterizes and encodes the salient features of the normalized excitation waveform for transmission.

FIG. 23 illustrates a method for encoding normalized excitation in accordance with a preferred embodiment of the present invention. The method is a time-domain method corresponds to Encode Normalized Excitation Means 290 (FIG. 1). The method begins with Filter Normalized Excitation step 291, which low-pass filters the statistically normalized excitation waveform. Low pass filtered (e.g., 0.125 Nyquist) representations of the normalized excitation waveform preserve overall speech quality while introducing little, if any, perceptual distortion.

Figure 24:
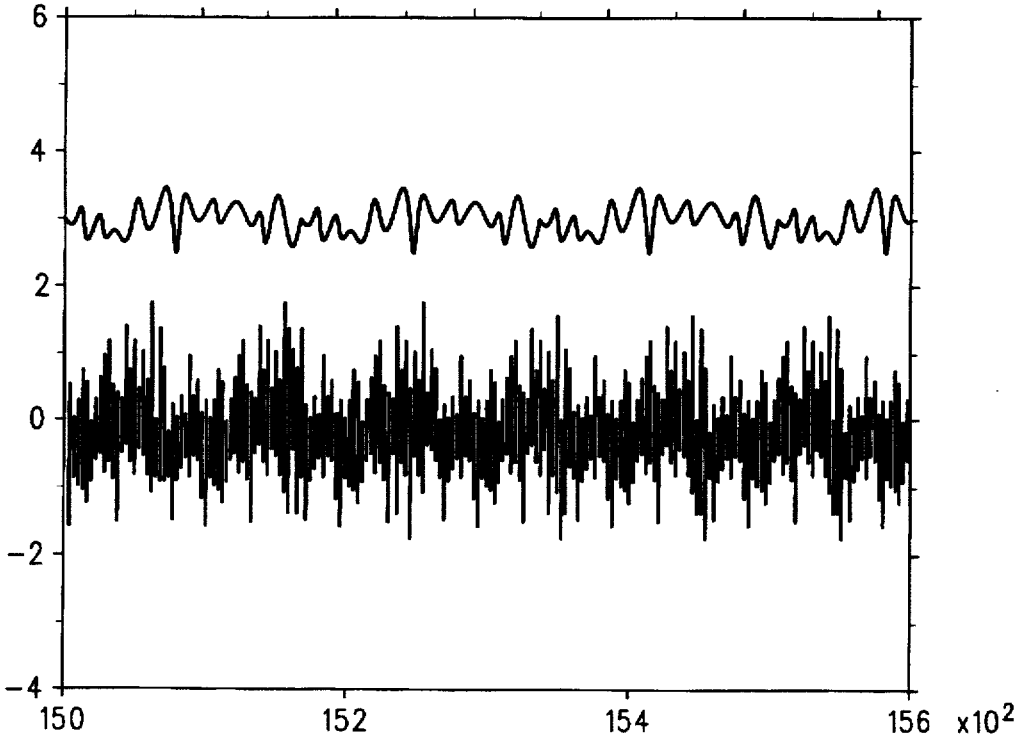
FIG. 24 illustrates an exemplary normalized excitation waveform and characterized normalized excitation waveform computed in accordance with a preferred embodiment of the present invention.

FIG. 24 illustrates an exemplary normalized excitation waveform and characterized normalized excitation waveform computed in accordance with a preferred embodiment of the present invention. The characterized representation of FIG. 24 preserves speech quality and improves coding efficiency. The low perceptual distortion achieved using filtered normalized excitation representations indicates that the normalized vector need not be accurately represented at lower bit rates.

Referring back to FIG. 23, following Filter Normalized Excitation step 291, Downsample Normalized Filtered Excitation step 292 downsamples the normalized, filtered excitation waveform to a common vector length for all normalized excitation vectors, resulting in a characterized excitation waveform vector. Next, Select Codebook Subset step 293 uses the degree of periodicity from Calculate Degree of Periodicity Means 30 (FIG. 1) to select a codebook subset corresponding to the identified class.

Encode Vector step 294 then uses the codebook subset and appropriate quantization methods to encode the characterized, length-normalized, time-domain excitation vector. These methods include VQ, split VQ, MSVQ, wavelet VQ, or wavelet TCQ quantizers. The Encode Vector step 294 produces at least one codebook index and a quantized, length-normalized ensemble statistic vector. The procedure then ends.

Figure 25:
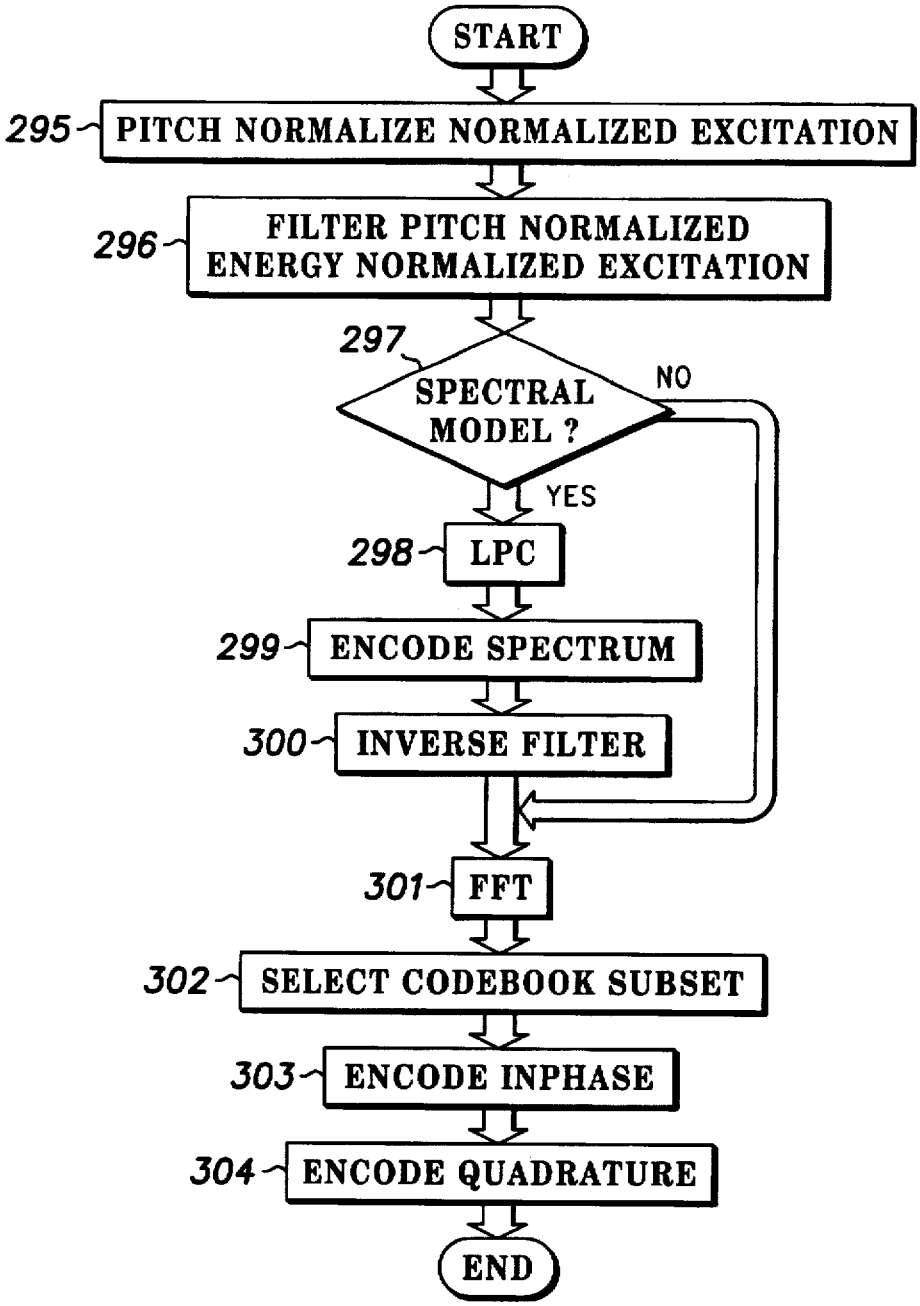
FIG. 25 illustrates a method for encoding normalized excitation in accordance with an alternate embodiment of the present invention.

FIG. 25 illustrates a method for encoding normalized excitation in accordance with an alternate embodiment of the present invention. The alternate embodiment is a frequency-domain method corresponding to Encode Normalized Excitation Means 290 (FIG. 1). The method begins with Pitch-Normalize Normalized Excitation step 295. Although the effective "local" pitch length of the normalized excitation epochs (i.e., the pitch for the current frame) is already normalized to within one sample from Estimate Epoch Locations Means 110 (FIG. 1), Pitch-Normalize Normalized Excitation step 295 can upsample or downsample each epoch segment of the normalized excitation waveform to a second "global" normalizing length (i.e., a common pitch length for all frames). By characterizing the normalized waveform in the pitch-normalized frequency domain, a harmonic-aligned, fixed length vector is produced which is ideal for quantization.

Figure 26:
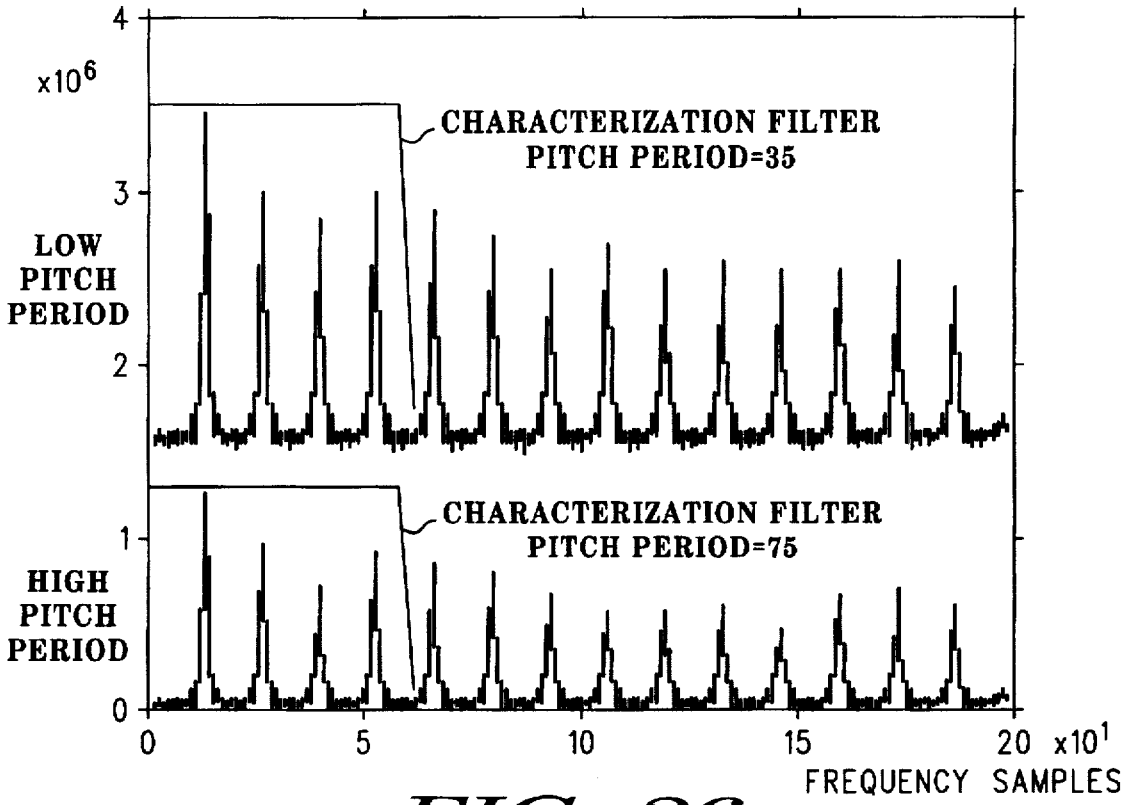
FIG. 26 illustrates an exemplary characterization filtering of the normalized excitation derived in accordance with a preferred embodiment of the present invention.

FIG. 26 illustrates an exemplary characterization filtering of the normalized excitation derived in accordance with a preferred embodiment of the present invention. The figure illustrates the magnitude spectrum of two normalized representative periodic waveforms with different pitch. The normalized excitation waveform spectrum is much less periodic. However, a latent periodic component can often be present since the normalization is performed on a length-normalized epoch synchronous basis. In the frequency domain, the harmonics of the length-normalized waveforms are automatically aligned with each other, thus simplifying quantization of the baseband representation. By lowpass filtering the normalized data (as shown in FIG. 26), quantization can be performed on harmonic-aligned, fixed-length vectors, (i.e., inphase and quadrature), thus improving quantization performance and subsequent speech quality. An effective characterization filter has been experimentally shown to require only four "harmonics" of the normalized excitation waveform, although more or fewer harmonics could also be appropriate.

Referring back to FIG. 25, characterization filtering of the excitation is performed by Filter Pitch-Normalized, Energy-Normalized Excitation step 296, which, in a preferred embodiment, performs a low-pass filter process as described above, resulting in a filtered excitation waveform.

In addition to direct normalized excitation characterization, a preferred embodiment of the invention performs steps 297 through 300, which use a form of indirect characterization via spectral modeling of the normalized excitation waveform. In this manner, a multi-pole LPC analysis and inverse filter are used to generate parameters describing the normalized excitation waveform spectral envelope and corresponding "excitation", each of which can be encoded separately. In an alternate embodiment, steps 297 through 300 are not performed.

In a preferred embodiment, a determination is made, in step 297, whether a spectral model method is employed. If so, LPC step 298 is performed. Given the preservation of four harmonics using the characterization filter illustrated in FIG. 26, a four pole spectral model is well-suited for representation of the characterized, normalized excitation waveform.

Figure 27:
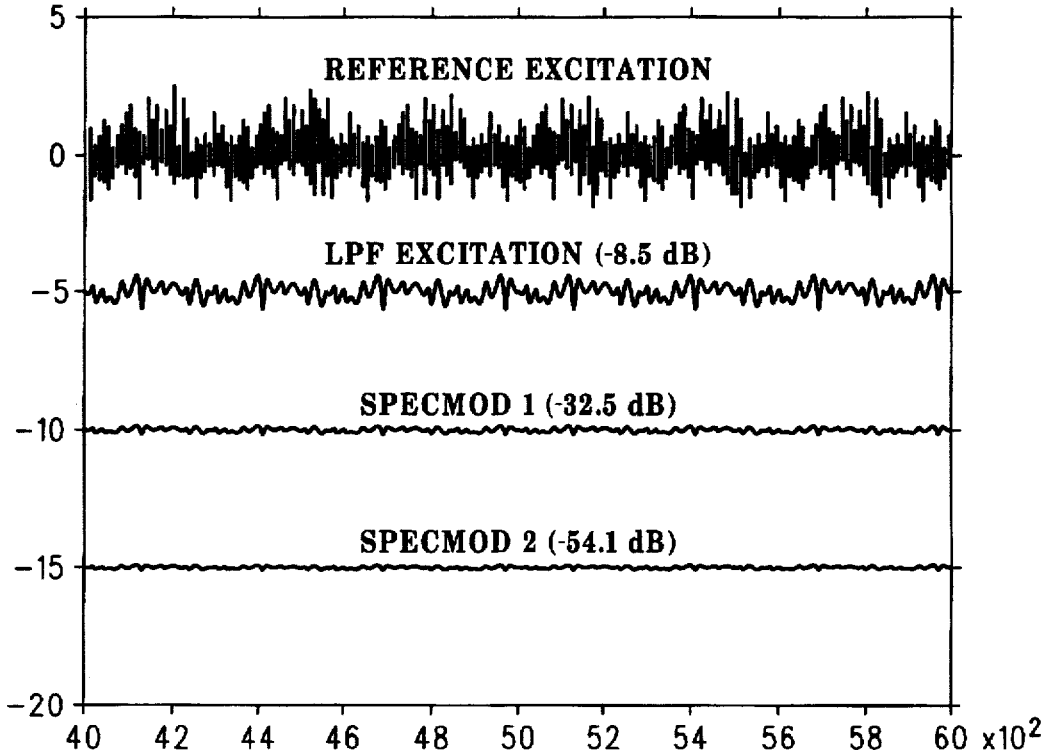
FIG. 27 illustrates an exemplary normalized excitation characterization using cascaded spectral models derived in accordance with a preferred embodiment of the present invention.

FIG. 27 illustrates an exemplary normalized excitation characterization using cascaded spectral models derived in accordance with a preferred embodiment of the present invention. The figure shows a normalized excitation waveform, a lowpass filtered (LPF) normalized excitation waveform, and cascaded four-pole residuals. Relative to the LPF normalized excitation, a power reduction of 24 dB for the first spectral model, and 45.6 dB for the second spectral model can be observed. A bandwidth versus speech quality tradeoff optimizes the bandwidth allocated to the all pole models and the corresponding residuals.

Referring back to FIG. 25, LPC step 298 performs an LPC analysis on the normalized, characterized, filtered excitation waveform, producing spectral model parameters. Following LPC step 298, Encode Spectrum step 299 encodes the spectral parameters using quantization methods such as VQ, split VQ, MS-VQ, wavelet VQ, and wavelet TCQ implementations. In a preferred embodiment, Encode Spectrum step 299 encodes H line spectral frequencies using an MSVQ, producing at least one code index and quantized spectral model parameters, although other coding methods could also be used. The quantized spectral model parameters and characterized, normalized, filtered excitation are used to generate spectral model excitation waveform in Inverse Filter step 300, which inverse filters the filtered excitation waveform using the spectral parameters.

After Inverse Filter step 300 or when a spectral model is not employed, the filtered excitation (e.g., the spectral model excitation) is transformed to the frequency domain in FFT step 301, which produces a frequency-domain representation. In a preferred embodiment, the frequency-domain representation comprises an inphase and quadrature waveform. Select Codebook Subset step 302 then uses the degree-of-periodicity computed in Calculate Degree of Periodicity 30 (FIG. 1) to select a codebook subset which corresponds to the identified class for the speech segment under analysis.

Encode Inphase step 303 then encodes the inphase component computed in FFT step 301 using the codebook subset and quantization methods such as VQ, split VQ, MSVQ, wavelet VQ, and wavelet TCQ implementations, producing one or more codebook indices.

Encode Quadrature step 304 then encodes the quadrature component computed in FFT step 301 using the codebook subset and using quantization methods such as VQ, split VQ, MSVQ, and wavelet TCQ implementations, producing one or more code indices. The procedure then ends.

While a preferred embodiment of Encode Normalized Excitation Method 290 encodes inphase and quadrature vectors, alternate embodiments could also be used which encode different representations of the normalized excitation, such as magnitude and phase representations.

Referring again to FIG. 1, Encode Normalized Excitation Means 290 is followed by Encode Degree of Periodicity Means 310, which scalar quantizes the degree of periodicity produced by Calculate Degree of Periodicity 30, producing a code index. Encode Degree of Periodicity Means 310 is followed by Encode Ensemble Alignment Means 350, which characterizes and encodes the alignment vector computed in Normalize Excitation Waveform Means 270.

Figure 28:
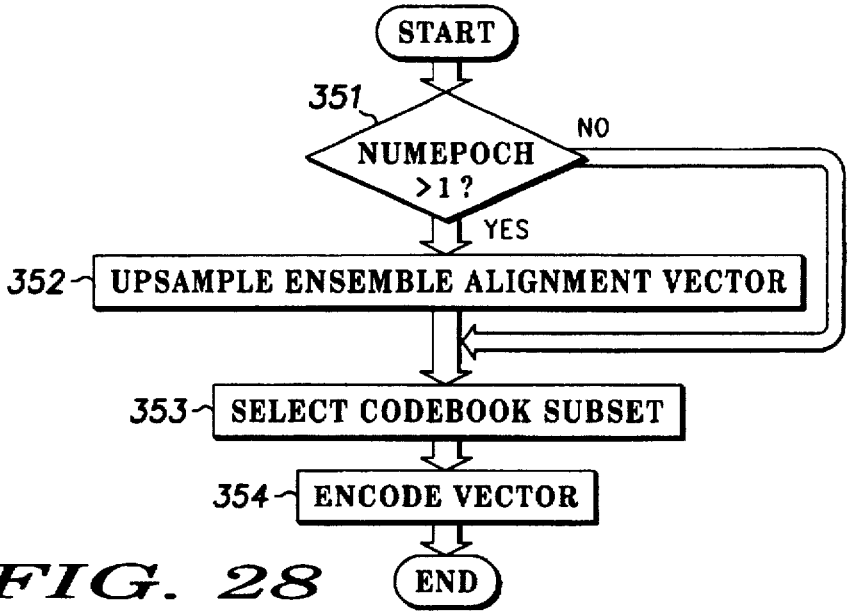
FIG. 28 illustrates a method for encoding ensemble alignment in accordance with a preferred embodiment of the present invention.

FIG. 28 illustrates a method for encoding ensemble alignment in accordance with a preferred embodiment of the present invention. The method corresponds to Encode Ensemble Alignment Means 350 (FIG. 1). The method begins by determining, in step 351, whether Numepoch>1, where Numepoch corresponds to the number of epochs in the current frame under analysis as calculated in Estimate Epoch Locations Means 110 (FIG. 1). When the number of epochs exceeds one, Upsample Ensemble Alignment Vector step 352 is performed, which upsamples the ensemble alignment vector to a common vector length. In a preferred embodiment of the invention, Upsample Ensemble Alignment Vector step 352 upsamples the vector, which initially has Numepoch samples, to a common length equal to the maximum number of epochs allowed per frame (e.g., twelve, although other normalizing lengths could also be appropriate).

Figure 29:
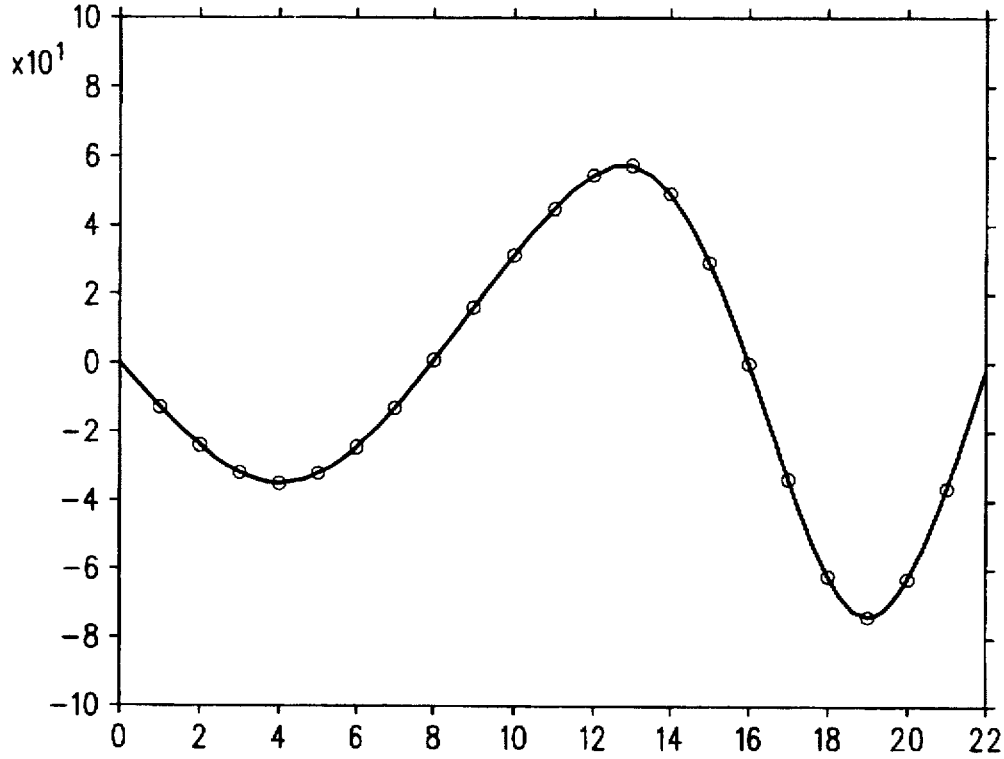
FIG. 29 illustrates an exemplary ensemble alignment vector derived in accordance with a preferred embodiment of the present invention.

FIG. 29 illustrates an exemplary ensemble alignment vector derived in accordance with a preferred embodiment of the present invention. Application of the ensemble alignment vector at the receiver provides a denormalized waveform which more closely matches the original excitation.

Referring back to FIG. 28, after Upsample Ensemble Alignment Vector step 352 or when the current analysis segment contains only one epoch, Select Codebook Subset step 353 is performed, which uses the degree-of-periodicity computed in Calculate Degree of Periodicity Means 30 (FIG. 1) to select a codebook subset which corresponds to the identified class for the speech segment under analysis. When the number of epochs is equal to one, the codebook subset can also include a scalar quantizer corresponding to the single scalar alignment value.

Encode Vector step 354 then encodes the ensemble alignment vector or scalar alignment value using the codebook subset and quantization methods such as VQ, split VQ, MSVQ, wavelet VQ, and wavelet TCQ implementations, producing one or more codebook indices. The procedure then ends.

Referring back to FIG. 1, Encode Ensemble Alignment Means 350 is followed by Modulation and Channel Interface Means 390, which creates a modulated bitstream corresponding to the encoded data. The modulated data bitstream is transmitted via Modulation and Channel Interface Means 390 to Transmission Medium 475, where the channel can be any communication medium, including fiber, RF, or coaxial cable, although other media are also appropriate. In an alternate embodiment, the bitstream can be stored in a memory device (not shown) so that the bitstream can be sent at a later time, or can be retrieved and decoded by a synthesis processor co-located with Analysis Processor 100.

Figure 2:
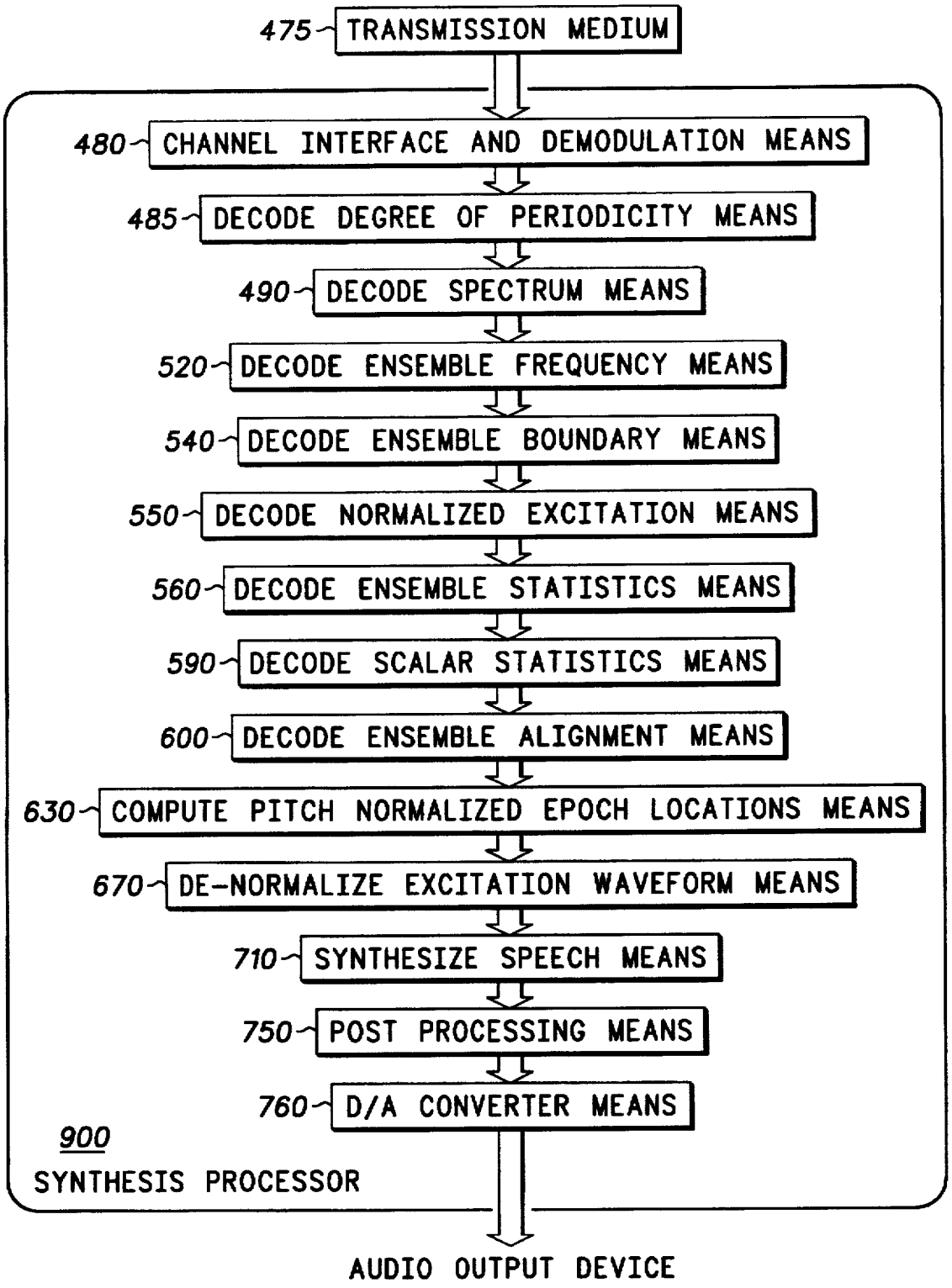
FIG. 2 illustrates a voice coding synthesis processor apparatus in accordance with a preferred embodiment of the present invention.

FIG. 2 illustrates voice coding synthesis processor apparatus 900 in accordance with a preferred embodiment of the present invention. As explained previously, Synthesis Processor 900 decodes encoded scalar statistics, ensemble statistics, spectral parameters, and a normalized excitation waveform which have been encoded by Analysis Processor 100. Synthesis Processor 900 can be remote from or co-located with Analysis Processor 100. After speech synthesis, Synthesis Processor 900 can output the decoded speech to an audio output device, such as a speaker, or can store the decoded speech in a memory device (not shown).

Where Synthesis Processor 900 is remotely located from Analysis Processor 100, Synthesis Processor 900 receives a modulated, transmitted bitstream via Transmission Medium 475 and demodulates the bitstream using Channel Interface and Demodulation Means 480, producing code indices corresponding to the code indices generated by Analysis Processor 100.

Channel Interface and Demodulation Means 480 is followed by Decode Degree of Periodicity Means 485, which decodes the degree of periodicity represented by one or more code indices produced by Channel Interface and Demodulation Means 480, producing a discrete degree of periodicity class.

Decode Degree of Periodicity Means 485 is followed by Decode Spectrum Means 490, which uses the one or more code indices produced by Channel Interface and Demodulation Means 480 and the companion codebooks to Encode Spectrum Means 155 (FIG. 1) to produce quantized spectral parameters. In a preferred embodiment, Decode Spectrum Means 490 selects from codebooks corresponding to each of the discrete degrees-of-periodicity produced by Decode Degree of Periodicity Means 485, although a non-class-based approach could also be appropriate in an alternate embodiment.

Decode Spectrum Means 490 is followed by Decode Ensemble Frequency Means 520, which decodes the number of epochs represented by a code index produced by Channel Interface and Demodulation Means 480, resulting in an integer number of epochs corresponding to the segment of speech to be synthesized.

Decode Ensemble Frequency Means 520 is followed by Decode Ensemble Boundary Means 540, which decodes the epoch-aligned boundary computed by Estimate Epoch Locations Means 110 (FIG. 1), producing an integer representing the analysis boundary sample index. Decode Ensemble Boundary Means 540 is followed by Decode Normalized Excitation Means 550.

Figure 30:
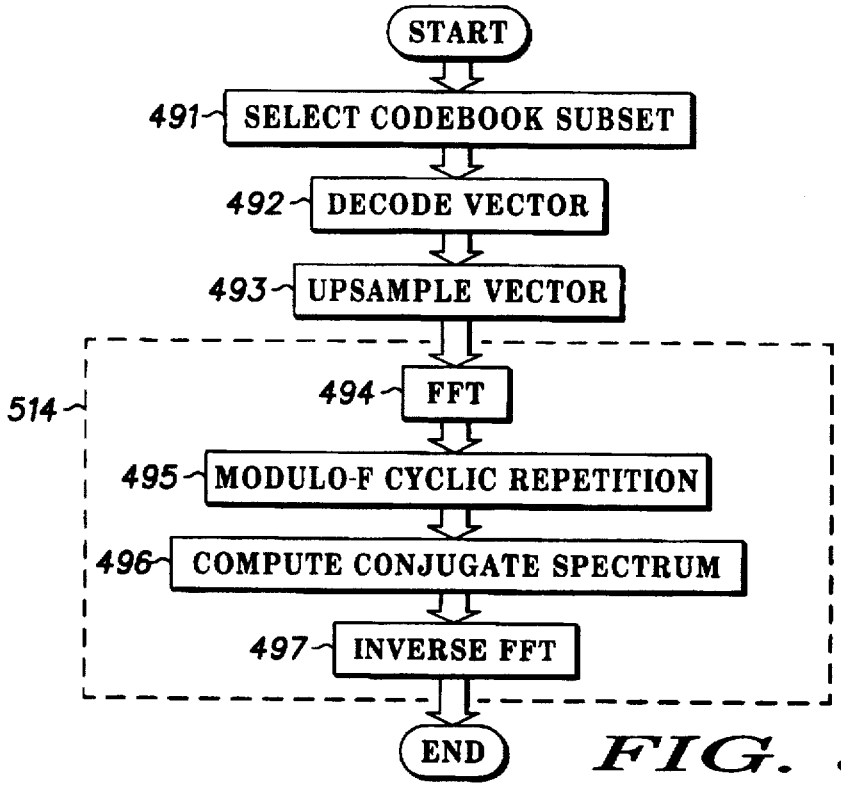
FIG. 30 illustrates a method for decoding normalized excitation in accordance with a preferred embodiment of the present invention.

FIG. 30 illustrates a method for decoding normalized excitation in accordance with a preferred embodiment of the present invention. The method begins with Select Codebook Subset step 491. Select Codebook Subset step 491 selects the normalized excitation codebook subset corresponding to the discrete degree-of-periodicity produced by Decode Degree of Periodicity Means 485 (FIG. 2), although a non-class-based approach could also be appropriate.

Next, Decode Vector step 492 uses the codebook subsets which are companions to those used by Encode Normalized Excitation Means 290 (FIG. 1) and the appropriate codebook indices from Channel Interface and Demodulation Means 480 (FIG. 2) to produce a characterized, quantized, normalized excitation vector. Upsample Vector step 493 then applies linear or nonlinear interpolation methods to the characterized, normalized excitation vector to produce a normalized excitation vector.

In a preferred embodiment, Simulate Highband process 514, which includes steps 494 through 497, is then performed, although an alternate embodiment might not perform Simulate Highband process 514. Simulate Highband process 514 simulates highband excitation components which were discarded by Encode Normalized Excitation Means 290 (FIG. 1). Simulate Highband process 514 begins with FFT step 494, which performs a Fast Fourier Transform upon the normalized excitation vector, producing a frequency-domain representation. In a preferred embodiment, the frequency-domain representation comprises inphase and quadrature vectors.

Modulo-F Cyclic Repetition step 495 then performs a cyclic process upon the frequency-domain representation (e.g., the baseband inphase and quadrature components) to produce an estimate of elided highband components. Lowpass characterization filtering of the normalized excitation preserves a relatively high-level speech quality and speaker recognizability. However, characterization filtering discards the normalized excitation high-frequency components, which can contribute to perceived quality. In order to mitigate the effects of lowpass characterization, post-processing methods can be introduced which enhance speech quality without sacrificing bandwidth. In a preferred embodiment of the present invention, perceived quality is improved in the face of normalized excitation characterization filtering by simulating high frequency inphase and quadrature components which were discarded at the transmitter. Modulo-F Cyclic Repetition step 495 represents a post-process which ultimately improves synthesized speech quality without the use of additional transmission bandwidth.

Figure 31:
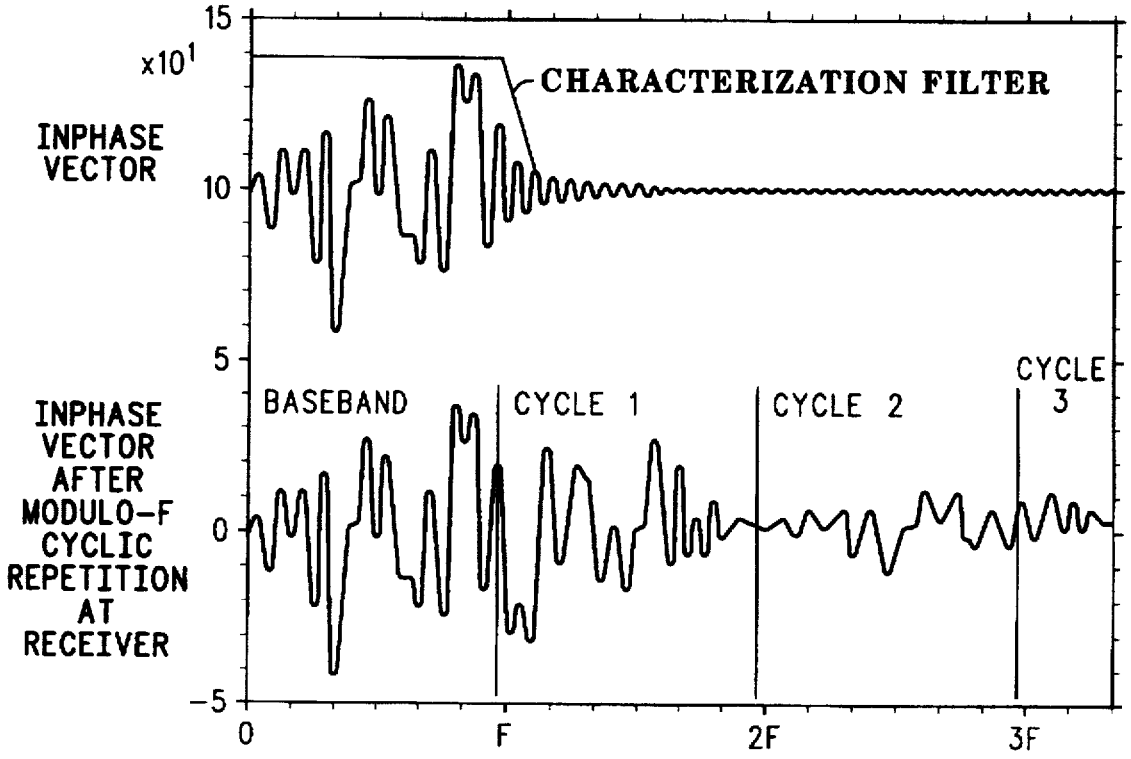
FIG. 31 illustrates an exemplary statistically normalized excitation reconstruction using modulo-F cyclic repetition in accordance with an alternate embodiment of the present invention.

FIG. 31 illustrates an exemplary statistically normalized excitation reconstruction using modulo-F cyclic repetition in accordance with an alternate embodiment of the present invention. The method enhances synthesized speech quality in conjunction with Modulo-F Cyclic Repetition step 495 (FIG. 30). In this method, the frequency-domain representation components (e.g., the inphase and quadrature components) are cyclically repeated at modulo-F intervals, where F represents a characterization filter cutoff. This results in contiguous successive inphase and quadrature cycles. In order to preserve waveform phase continuity, the sign of each contiguous successive cycle is changed with each cycle. A linear trapezoidal weighting is applied across the synthesized upper frequencies of the cycles in order to reduce high frequency energy. This technique provides an improvement in quality which is manifest in an apparent "brightening" of the synthesized speech. Quadrature data is modified in the same manner as the inphase data of FIG. 31.

Figure 32:
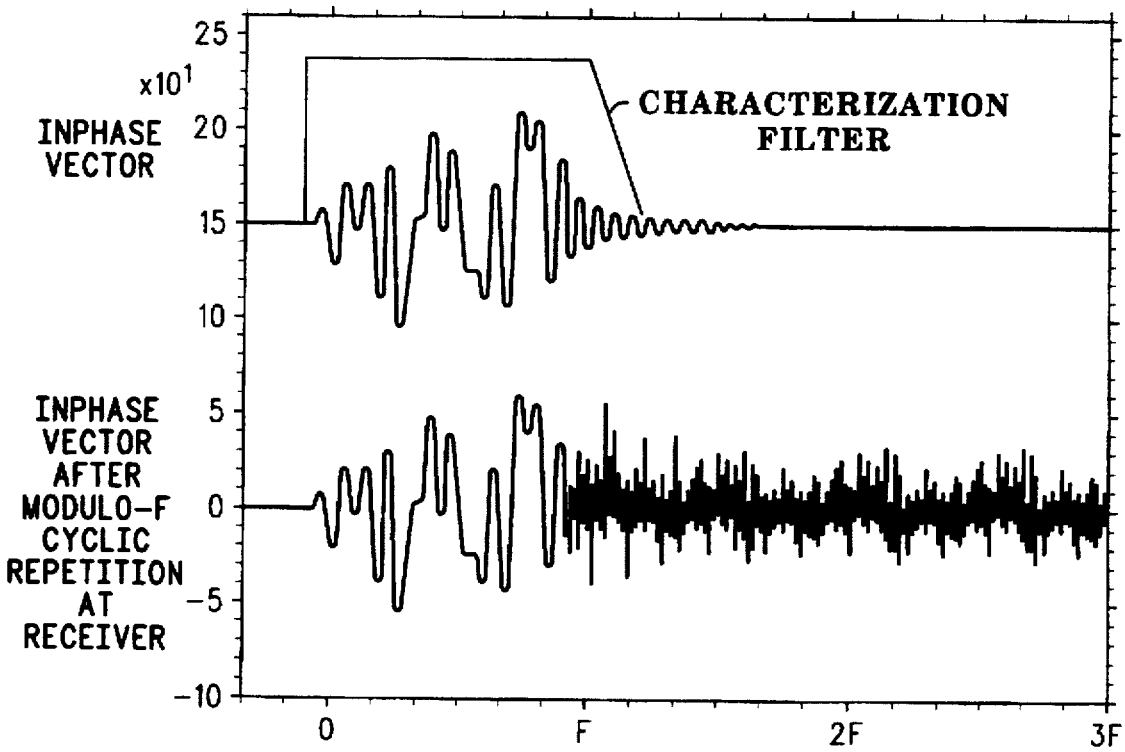
FIG. 32 illustrates an exemplary statistically normalized excitation reconstruction using modulo-F cyclic repetition plus noise in accordance with a preferred embodiment of the present invention.

FIG. 32 illustrates an exemplary statistically normalized excitation reconstruction using modulo-F cyclic repetition plus noise in accordance with a preferred embodiment of the present invention. This technique provides the greatest speech quality improvement for aperiodic speech, as determined by the degree-of-periodicity class. Noise power can be proportional to the baseband energy, although other noise power levels can also be appropriate. In a preferred embodiment, the noise power can be proportional to the degree of periodicity class produced by Decode Degree of Periodicity Means 485 (FIG. 2).

Although this embodiment relies upon classification to perform optimally, classification errors do not significantly impact the synthesized result. Since baseband-normalized excitation is always preserved, high classification accuracy is not critical to success of the method. Hence, the method can be used with or without degree-of-periodicity class control.

Referring back to FIG. 30, following Modulo-F Cyclic Repetition step 495, Compute Conjugate Spectrum step 496 uses the inphase vector and quadrature vector to produce the conjugate FFT spectrum. Compute Conjugate Spectrum step 496 produces a second frequency-domain representation having the same number of inphase samples and quadrature samples used to transform the normalized excitation component in FFT step 494.

Next, Inverse FFT step 497 performs an inverse Fast Fourier Transform on the second frequency-domain representation, producing a time domain, normalized excitation vector with simulated highband components. The procedure then ends.

Figure 33:
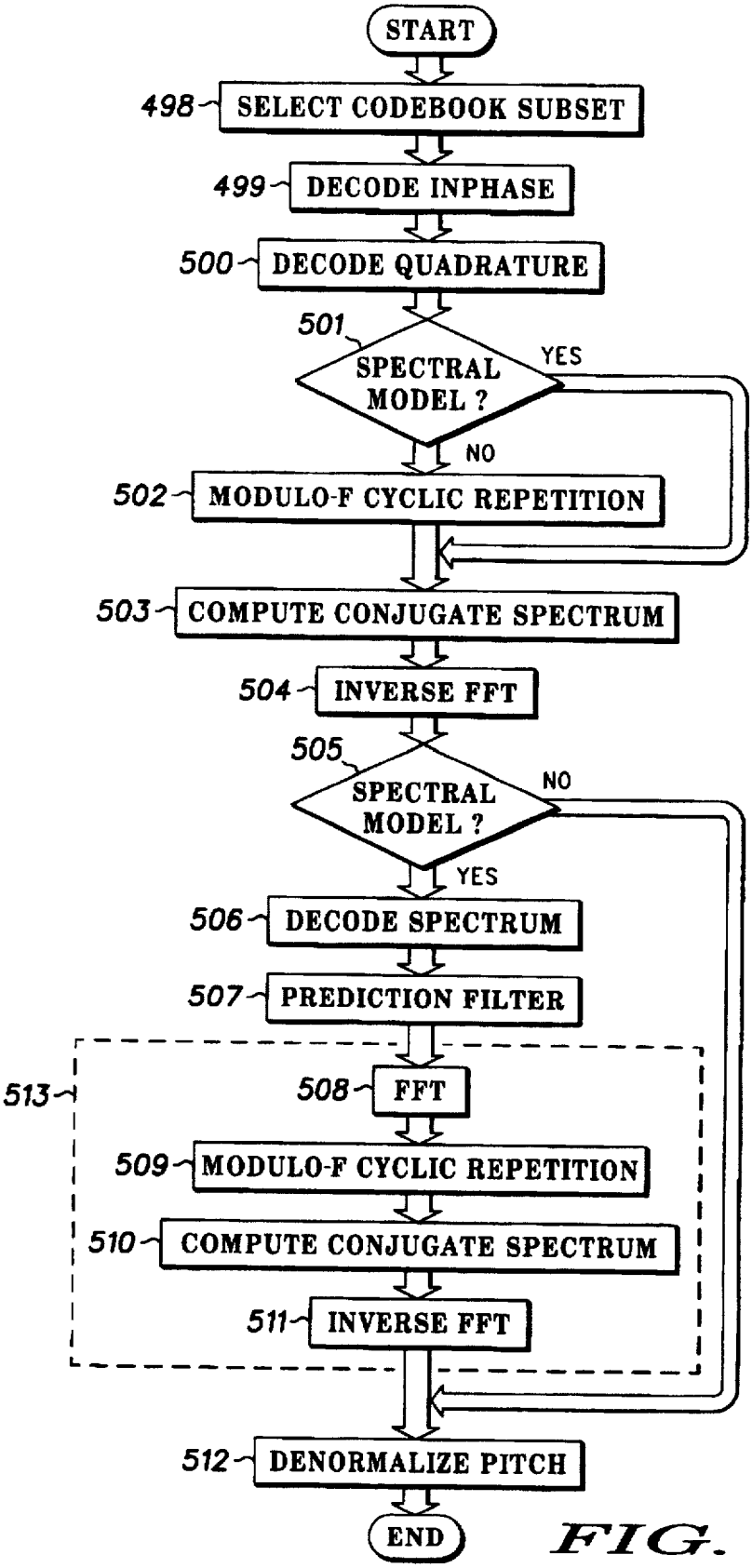
FIG. 33 illustrates a method for decoding normalized excitation in accordance with an alternate embodiment of the present invention.

FIG. 33 illustrates a method for decoding normalized excitation in accordance with an alternate embodiment of the present invention. The method corresponds to Decode Normalized Excitation Means 490 (FIG. 2) and is a companion decoding method for Encode Normalized Excitation Means 290 (FIG. 1). The method begins with Select Codebook Subset step 498. Select Codebook Subset step 498 selects the normalized excitation codebook subsets corresponding to the discrete degree-of-periodicity produced by Decode Degree of Periodicity Means 485 (FIG. 2), although a non-class-based approach could also be appropriate.

Next, Decode Inphase step 499 uses the codebook subsets which are companion codebooks to those used in Encode Normalized Excitation Means 290 (FIG. 1) and the appropriate codebook indices from Channel Interface and Demodulation Means 480 (FIG. 2) to decode an inphase component of a frequency-domain representation of the normalized excitation waveform, resulting in a characterized, quantized, inphase vector. Decode Quadrature step 500 then uses the codebook subsets which are companion codebooks to those used in Encode Normalized Excitation Means 290 (FIG. 1) and the appropriate codebook indices from Channel Interface and Demodulation Means 480 (FIG. 2) to decode a quadrature component of the frequency-domain representation of the normalized excitation waveform, resulting in a characterized, quantized, quadrature vector.

In a preferred embodiment, steps 501 and 502 are then performed, although in an alternate embodiment, these steps are omitted. In step 501, a determination is made whether a spectral model was used by Encode Normalized Excitation Means 290. When a spectral model was not used, Modulo-F Cyclic Repetition step 502 is performed in the manner described in conjunction with FIG. 30.

After Modulo-F Cyclic Repetition step 502, or when a spectral model was used, Compute Conjugate Spectrum step 503 is performed. Compute Conjugate Spectrum step 503 uses the inphase vector and quadrature vector to produce a conjugate FFT spectrum. Compute Conjugate Spectrum step 503 produces the same number of inphase samples and quadrature samples used to transform the normalized excitation component in Encode Normalized Excitation Means 290 (FIG. 1).

Next, Inverse FFT step 504 performs an inverse Fast Fourier Transform on the inphase and quadrature components, producing a time domain vector. A determination is again made, in step 505, whether a spectral model is employed. When the spectral model is not employed, the output of Inverse FFT step 504 represents the quantized normalized excitation waveform and Denormalize Pitch step 512 is performed in a preferred embodiment. Denormalize Pitch step 512 performs an inverse epoch-synchronous process to that described in Encode Normalized Excitation Means 290 (FIG. 1) to produce a time domain, normalized excitation vector with proper local pitch. In an alternate embodiment, Denormalize Pitch step 512 is omitted. The procedure then ends.

If the spectral model is employed as determined in step 505, the output of Inverse FFT step 504 represents a residual of the spectral model and Decode Spectrum step 506 is performed. Decode Spectrum step 506 decodes the spectral model parameters derived from the normalized excitation waveform using the codebook subsets which represent companion codebooks to those implemented in Encode Normalized Excitation Means 290 (FIG. 1). The decoded spectral model parameters correspond to the reconstructed spectral model residual. Next, the spectral model parameters and spectral model excitation are used by Prediction Filter step 507 to produce the quantized, normalized excitation waveform.

In a preferred embodiment, Simulate Highband process 513, which includes steps 508 through 511, is then performed, although an alternate embodiment might not perform Simulate Highband process 513. Simulate Highband process 513 simulates highband excitation components which were discarded by Encode Normalized Excitation Means 290 (FIG. 1).

Simulate Highband process 513 begins with FFT step 508, which performs a Fast Fourier Transform upon the normalized excitation vector, producing a frequency-domain representation. In a preferred embodiment, the frequency-domain representation includes inphase and quadrature vectors. Next, Modulo-F Cyclic Repetition step 509 performs in the manner described in conjunction with FIG. 30, resulting in a second frequency-domain representation. Following Modulo-F Cyclic Repetition step 509, Compute Conjugate Spectrum step 510 uses the second frequency-domain representation (e.g., the inphase vector and quadrature vectors) to produce the conjugate FFT spectrum. Compute Conjugate Spectrum step 510 produces the same number of frequency-domain representation samples used to transform the normalized excitation component in FFT step 508. Next, Inverse FFT step 511 performs an inverse Fast Fourier Transform on the second frequency-domain representation (e.g., the inphase and quadrature components), producing a time-domain, normalized excitation vector with simulated highband components.

Following Simulate Highband process 513, Denormalize Pitch step 512 is performed in a preferred embodiment, although in an alternate embodiment, Denormalize Pitch step 512 could be omitted. Denormalize Pitch step 512 performs an inverse epoch-synchronous process to that described in conjunction with Encode Normalized Excitation Means 290 (FIG. 1) to produce a time domain, normalized excitation vector with simulated highband components and proper local pitch. The procedure then ends.

Figure 34:
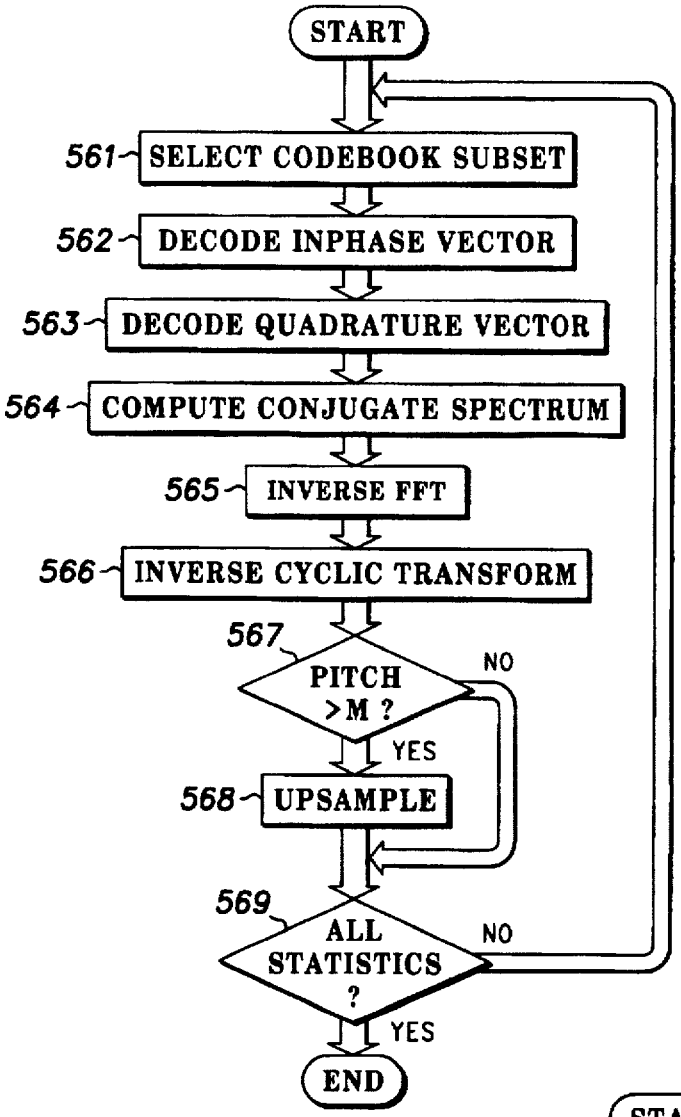
FIG. 34 illustrates a method for decoding ensemble statistics in accordance with a preferred embodiment of the present invention.

Referring again to FIG. 2, Decode Normalized Excitation Means 550 is followed by Decode Ensemble Statistics Means 560. FIG. 34 illustrates a method for decoding ensemble statistics in accordance with a preferred embodiment of the present invention. The method corresponds to Decode Ensemble Statistics Means 560 (FIG. 2). The method begins with Select Codebook Subset step 561, which selects a codebook subset from the ensemble statistic codebooks corresponding to the discrete degree-of-periodicity produced by Decode Degree of Periodicity Means 485 (FIG. 2), although a non-class-based approach could also be appropriate.

Select Codebook Subset step 561 is followed by steps 562 and 563 which decode a frequency-domain representation of an encoded ensemble statistic using the codebook subset. In a preferred embodiment, the frequency-domain representation comprises an inphase vector and a quadrature vector. Decode Inphase Vector step 562, which uses the companion codebooks to those used by Encode Ensemble Statistics Means 230 (FIG. 1) and the appropriate codebook indices from Channel Interface and Demodulation Means 480 (FIG. 2) to produce a characterized, quantized, inphase vector. Next, Decode Quadrature Vector step 563 uses the companion codebooks to those used by Encode Ensemble Statistics Means 230 (FIG. 1) and the appropriate codebook indices from Channel Interface and Demodulation Means 480 (FIG. 2) to produce a characterized, quantized, quadrature vector.

Compute Conjugate Spectrum step 564 then uses the frequency-domain representation (e.g., the inphase vector and quadrature vector) to produce the conjugate FFT spectrum. Compute Conjugate Spectrum step 564 produces the same number of frequency-domain representation samples used to transform the ensemble statistic component in Encode Ensemble Statistics Means 230 (FIG. 1).

Next, Inverse FFT step 565 performs an inverse Fast Fourier Transform on the frequency-domain representation (e.g., the inphase and quadrature components), producing a time-domain vector representing the quantized, cyclically-shifted, ensemble statistic. Following Inverse FFT step 565, Inverse Cyclic Transform step 566 performs an inverse shifting process substantially similar to that described in conjunction with Encode Ensemble Statistics Means 230 (FIG. 1), producing a quantized ensemble statistic vector.

A determination is then made, in step 567, whether Pitch>M, or whether the pitch of the ensemble statistic, determined from Decode Ensemble Frequency Means 520 (FIG. 2) and Decode Ensemble Boundary Means 540 (FIG. 2), exceeds the characterization vector length. If the pitch does exceed the characterization vector length, Upsample step 568 upsamples the ensemble statistic by performing a linear or nonlinear interpolation process to generate a quantized ensemble statistic vector of the proper pitch length.

After Upsample step 568, or if the pitch does not exceed the characterization vector length, a determination is made, in step 569, whether all statistics have been decoded. When all statistics have not been decoded, the procedure branches to repeat the process. Otherwise, the procedure ends.

Figure 35:
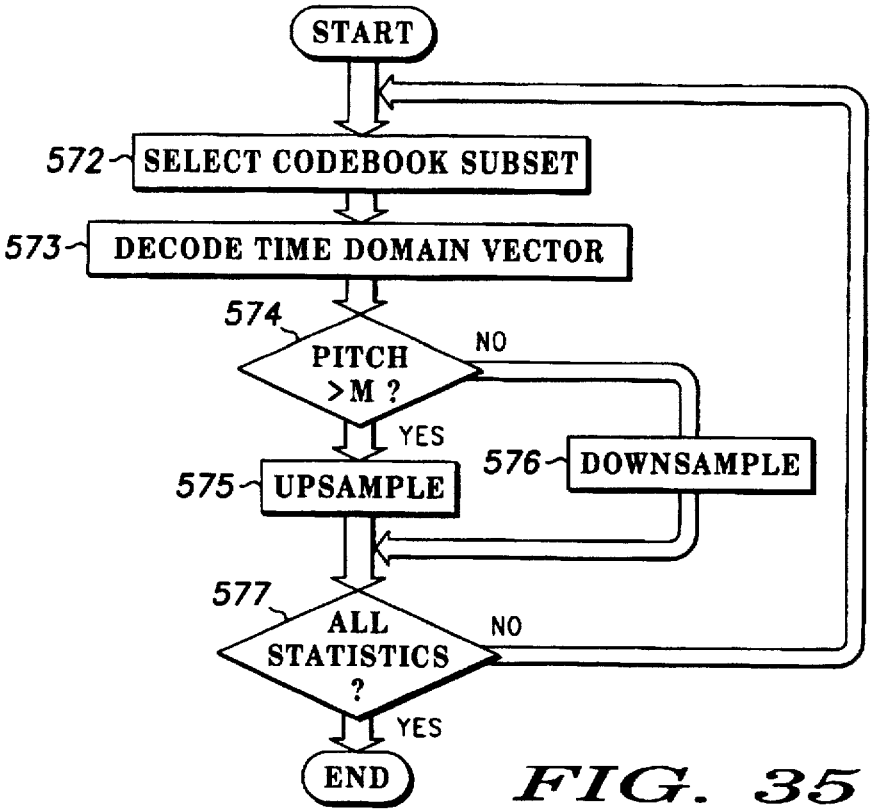
FIG. 35 illustrates a method for decoding ensemble statistics in accordance with an alternate embodiment of the present invention.

FIG. 35 illustrates a method for decoding ensemble statistics in accordance with an alternate embodiment of the present invention. The method corresponds to Decode Ensemble Statistics Means 560 (FIG. 2). The method begins with Select Codebook Subset step 572 which selects a codebook subset from the ensemble statistic codebooks corresponding to the discrete degree-of-periodicity produced by Decode Degree of Periodicity Means 485 (FIG. 2), although a non-class-based approach could also be appropriate.

Select Codebook Subset step 572 is followed by Decode Time Domain Vector step 573, which uses the codebook subsets which are companion codebooks to those used in Encode Ensemble Statistics Means 230 (FIG. 1) and the appropriate codebook indices from Channel Interface and Demodulation Means 480 (FIG. 2) to produce a characterized, quantized, time-domain ensemble statistic vector.

Next, a determination is made, in step 574, whether Pitch>M, or whether the characterized vector length M is smaller than the current pitch. If so, Upsample step 575 is performed, which upsamples the time-domain ensemble statistic vector. When the characterized vector length M is larger than the current pitch, Downsample step 576 is performed which downsamples the time-domain ensemble statistic vector.

A determination is then made, in step 577, whether all ensemble statistics (i.e., ensemble mean and ensemble standard deviation) have been decoded. When all ensemble statistics have not been decoded, the procedure branches to repeat the process for the next statistic. Otherwise, the procedure ends.

Figure 36:
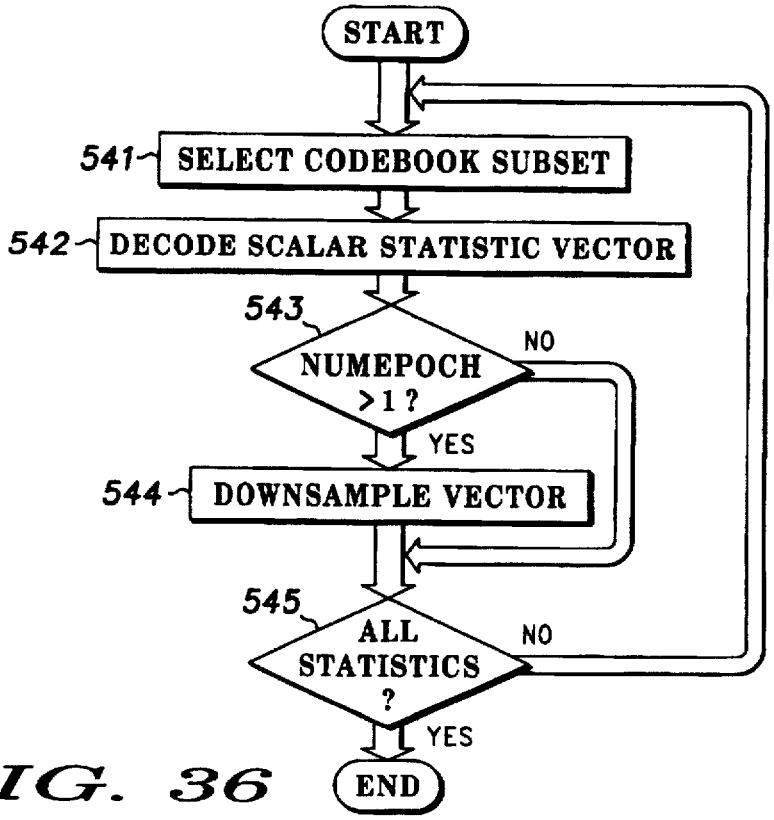
FIG. 36 illustrates a method for decoding scalar statistics in accordance with a preferred embodiment of the present invention.

Referring again to FIG. 2, Decode Ensemble Statistics Means 560 is followed by Decode Scalar Statistics Means 590. FIG. 36 illustrates a method for decoding scalar statistics in accordance with a preferred embodiment of the present invention. The method corresponds to Decode Scalar Statistics Means 590 (FIG. 2). The method begins with Select Codebook Subset step 541, which selects a codebook subset from the scalar statistic codebooks corresponding to the discrete degree-of-periodicity produced by Decode Degree of Periodicity Means 485 (FIG. 2), although a non-class-based approach could also be appropriate.

Select Codebook Subset step 541 is followed by Decode Scalar Statistic Vector step 542, which uses the codebook subset which represents companion codebooks to those used in Encode Scalar Statistics Means 230 (FIG. 1) and the appropriate codebook indices from Channel Interface and Demodulation Means 480 (FIG. 2) to produce a characterized, quantized, time-domain scalar statistic vector.

A determination is then made, in step 543, whether the number of epochs in the encoded, normalized excitation waveform exceeds one, or whether Numepoch>1. If so, Downsample Vector step 544 is performed, which downsamples the time-domain scalar statistic vector using linear or nonlinear decimation to produce a scalar statistic vector of length equal to the number of epochs in the excitation segment being reconstructed.

After Downsample Vector step 544, or if the number of epochs does not exceed one, a determination is made, in step 545, whether all encoded scalar statistics have been decoded, (i.e., scalar mean, and scalar standard deviation). If not, the procedure branches to repeat the process for the next statistic. If so, the procedure ends.

In addition to the steps shown in PIG. 36, a method corresponding to Decode Scalar Statistics Means 540 (FIG. 2) can also include steps for decoding an average scalar mean and an average scalar standard deviation computed over the segment of excitation being modeled, and denormalizing the scalar statistic vectors by the average scalar statistic values.

Figure 37:
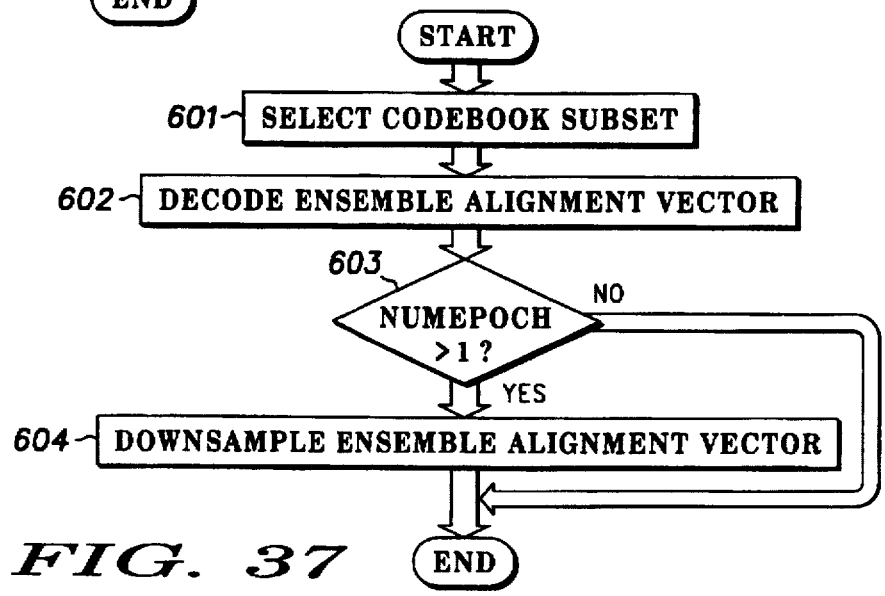
FIG. 37 illustrates a method for decoding ensemble alignment in accordance with a preferred embodiment of the present invention.

Referring again to FIG. 2, Decode Scalar Statistics Means 590 is followed by Decode Ensemble Alignment Means 600. FIG. 37 illustrates a method for decoding ensemble alignment in accordance with a preferred embodiment of the present invention. The method corresponds to Decode Ensemble Alignment Means 600 (FIG. 2). The method begins with Select Codebook Subset step 601. Select Codebook Subset step 601 selects a codebook subset from the ensemble alignment codebooks corresponding to the discrete degree-of-periodicity produced by Decode Degree of Periodicity Means 485 (FIG. 2), although a non-class-based approach could also be appropriate.

Next, Decode Ensemble Alignment Vector step 602 uses the codebook subsets which represent companion codebooks to those used by Encode Ensemble Alignment Means 350 (FIG. 1), and the codebook indices produced by Channel Interface and Demodulation Means 480 (FIG. 2) to produce a characterized ensemble alignment vector.

A determination is then made, in step 603, whether the number of epochs (i.e., Numepoch) in the encoded, normalized excitation waveform exceeds one, or whether Numepoch>1. If so, Downsample Ensemble Alignment Vector step 604 is performed, which downsamples the characterized ensemble alignment vector by implementing linear or nonlinear decimation to produce an ensemble alignment vector of Numepoch samples. The ensemble alignment vector is later used in the denormalization process.

After Downsample Ensemble Alignment Vector step 604, or when the number of epochs does not exceed one, the procedure ends.

Referring again to FIG. 2, Decode Ensemble Alignment Means 600 is followed by Compute Pitch Normalized Epoch Locations Means 630, which uses the ensemble frequency produced by Decode Ensemble Frequency Means 520 (FIG. 2), and the ensemble boundary produced by Decode Ensemble Boundary Means 540 (FIG. 2) to produce receiver epoch locations identical to those computed at the transmitter. Compute Pitch Normalized Epoch Locations Means 630 uses a method substantially similar to that illustrated in FIG. 9 which corresponds to Compute Pitch Normalized Epoch Locations Means 170 (FIG. 1).

Figure 38:
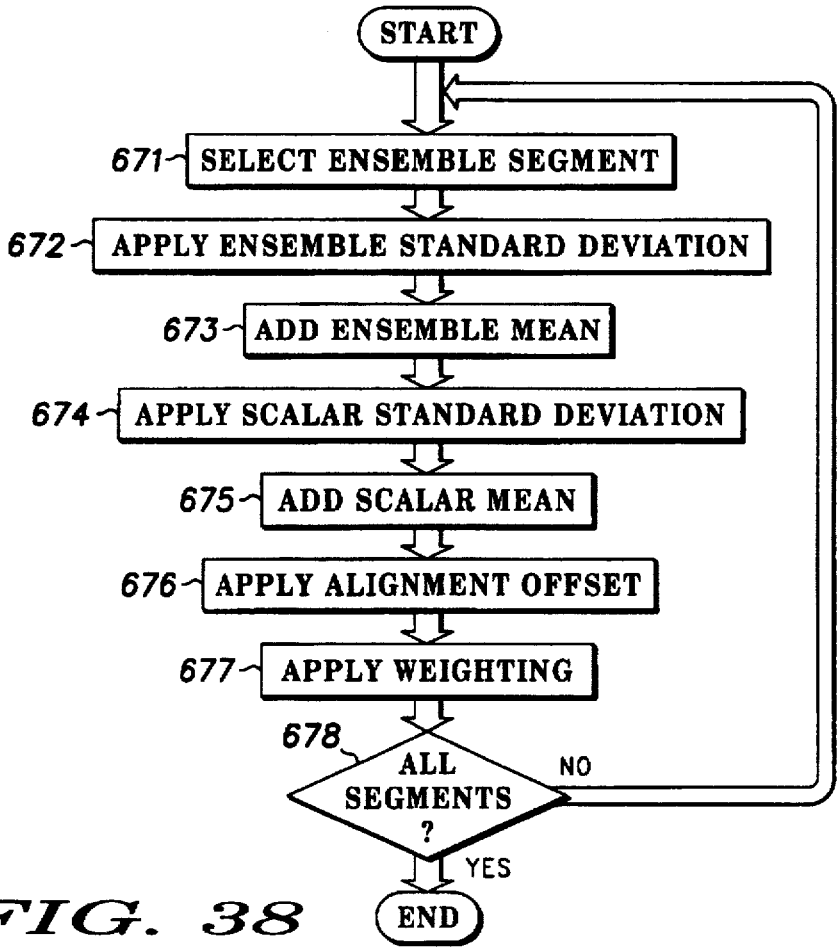
FIG. 38 illustrates a method for denormalizing an excitation waveform in accordance with a preferred embodiment of the present invention.

Compute Pitch Normalized Epoch Locations Means 630 is followed by Denormalize Excitation Waveform Means 670. FIG. 38 illustrates a method for denormalizing an excitation waveform in accordance with a preferred embodiment of the present invention. The method corresponds to Denormalize Excitation Waveform Means 670 (FIG. 2). The method begins with Select Ensemble Segment step 671. Select Ensemble Segment step 671 uses the normalized excitation from Decode Normalized Excitation Means 550 (FIG. 2) and the epoch locations from Compute Pitch Normalized Epoch Locations Means 630 (FIG. 2) to select a first epoch-synchronous segment boundary of normalized excitation (i.e., an ensemble segment).

Apply Ensemble Standard Deviation step 672 next multiplies the ensemble segment by the ensemble standard deviation produced by Decode Ensemble Statistics Means 560 (FIG. 2) to produce a second ensemble segment. Next, Add Ensemble Mean step 673 adds the ensemble mean produced by Decode Ensemble Statistics Means 560 (FIG. 2) to the second ensemble segment to produce a third ensemble segment. Apply Scalar Standard Deviation step 674 then multiplies the third ensemble segment by a single scalar standard deviation produced by Decode Scalar Statistics Means 590 (FIG. 2) corresponding to the epoch being reconstructed, producing a fourth ensemble segment. Next, Add Scalar Mean step 675 adds to the fourth ensemble segment a single scalar mean value produced by Decode Scalar Statistics Means 590 (FIG. 2) corresponding to the epoch being reconstructed, producing a denormalized, shifted excitation segment.

Following Add Scalar Mean step 675, Apply Alignment Offset step 676 shifts the denormalized excitation segment by the signal scalar alignment offset produced by Decode Ensemble Alignment Means 600 (FIG. 2) corresponding to the epoch being reconstructed, producing a denormalized excitation segment. In a preferred embodiment, an optional weighting function is then applied to the denormalized excitation segment in Apply Weighting step 677 to produce a denormalized, weighted excitation segment. In an alternate embodiment, Apply Weighting step 677 could be omitted. Apply Weighting step 677 can use any appropriate weighting function, such as a hamming window or raised cosine window, in order to minimize excitation segment boundary discontinuities.

A determination is then made, in step 678, whether all epoch synchronous segments have been denormalized. When all epoch synchronous segments have not been denormalized, the procedure branches back to Select Ensemble Segment step 671, and the procedure repeats. When all segments have been denormalized, resulting in a decoded excitation waveform, the procedure ends.

Referring again to FIG. 2, following Denormalize Excitation Waveform Means 670, Synthesize Speech Means 710 uses the denormalized excitation estimate to reconstruct high-quality speech. For example, Synthesize Speech Means 710 can include direct form or lattice synthesis filters which implement the reconstructed excitation waveform and LPC prediction coefficients or reflection coefficients.

Post Processing Means 750 consists of signal post processing methods, including adaptive post filtering techniques and spectral tilt re-introduction. Reconstructed, post-processed, digitally-sampled speech from Post Processing Means 750 can then be converted to an analog signal via D/A Converter Means 760 and output to an audio output device (not shown), producing output speech audio. Alternatively, the digital signal or analog signal could be stored to an appropriate storage medium (not shown).

In summary, the method and apparatus of the present invention provides an identity-system capability which is ideal for application toward variable rate implementations. Given enough bandwidth, the invention achieves transparent speech output. As such, variable rate embodiments can be developed from a preferred embodiment via a simple change of codebooks. In this fashion, the same algorithm is used across multiple data rates.

A variable-rate implementation of the invention simplifies hardware and software requirements in systems that require multiple data rates, improves performance in environments with widely varying interference conditions, and provides for improved bandwidth utilization in multi-channel applications. In a variable rate embodiment, VQ, split VQ, wavelet VQ, wavelet TCQ, or MSVQ codebooks can be developed with varying bit allocations at each desired level of bandwidth.

In one embodiment, MSVQs can be developed which incorporate multiple stages corresponding to higher levels of bandwidth. In this manner, low-level stages can be omitted at lower bit rates, with a corresponding drop in speech quality. Higher bit rate implementations would use more of the MSVQ stages to achieve higher speech quality. Hence, MSVQ implementations would provide for rapid changes in data rate.

At high bit rates, the variable-rate vocoder could achieve near transparent speech quality by full application of codebooks of all modeled parameters. At lower bit rates, codebook allocations can be reduced, or specific non-critical parameters can be discarded to meet system bandwidth requirements. In this manner, the bandwidth formerly allocated to those parameters can be used for other purposes. In one embodiment, the method and apparatus of the present invention can be used to open multiple channels within a fixed bandwidth by reducing the bandwidth allocated to each channel. The multi-rate embodiment would also be useful in high interference environments, whereby more channel bandwidth is allocated toward forward error correction in order to preserve intelligibility.

The present invention has been described above with reference to preferred and alternate embodiments. However, those skilled in the art will recognize that changes and modifications may be made in these embodiments without departing from the scope of the present invention. For example, the ensemble statistics and scalar statistics can be derived directly from the speech waveform rather than from the excitation waveform. This would eliminate the need to perform an LPC analysis on the input speech. In addition, the processes and stages identified herein may be categorized and organized differently than described herein while achieving equivalent results. These and other changes and modifications which are obvious to those skilled in the art are intended to be included within the scope of the present invention.

What is claimed is:

1. A method for encoding a speech waveform comprising the steps of:

a) generating a first excitation waveform by performing a linear prediction coefficient (LPC) analysis on a number of samples of input speech and inverse filtering the samples of input speech;

b) computing scalar statistics and ensemble statistics of the first excitation waveform;

c) encoding the scalar statistics and the ensemble statistics; and d) creating a bitstream which includes encoded versions of the scalar statistics and the ensemble statistics.

2. The method as claimed in claim 1, wherein step a) comprises the steps of:

a1) computing a frame-synchronous LPC analysis and inverse filtering a first number of samples of input speech, resulting in a second excitation waveform, wherein the first number of samples of input speech comprise a frame of speech;

a2) calculating a pitch from the frame of speech;

a3) estimating epoch locations from the frame of speech, the second excitation waveform, and the pitch;

a4) setting an analysis window corresponding to the epoch locations for an integer number of epochs, resulting in an epoch-aligned analysis segment; and a5) performing the LPC analysis and inverse filtering the epoch-aligned analysis segment, resulting in the first excitation waveform and prediction coefficients.

3. The method as claimed in claim 2, wherein step a2) comprises the steps of:

a2a) bandpass filtering the frame of speech, resulting in a filtered frame of speech;

a2b) computing multiple subframe autocorrelations of the filtered frame of speech;

a2c) selecting a maximum correlation subset from the multiple subframe autocorrelations;

a2d) selecting an initial pitch estimate from the maximum correlation subset;

a2e) searching for harmonic locations corresponding to the initial pitch estimate in the maximum correlation subset; and a2f) selecting a minimum harmonic location of the harmonic locations, the minimum harmonic location corresponding to the pitch.

4. The method as claimed in claim 2, wherein step a3) comprises the steps of:

a3a) low-pass filtering the frame of speech, resulting in filtered speech samples;

a3b) determining a waveform sense for each of the filtered speech samples, the frame of speech, and the second excitation waveform;

a3c) applying the waveform sense to each of the filtered speech samples, the frame of speech, and the second excitation waveform;

a3d) rectifying the filtered speech samples, the frame of speech, and the second excitation waveform;

a3e) setting deviation factors for each of the filtered speech samples, the frame of speech, and the second excitation waveform;

a3f) searching the filtered speech samples for first peaks at intervals defined by the pitch, including a first deviation factor, resulting in filtered speech peak locations;

a3g) searching the frame of speech for second peaks including a second deviation factor, resulting in speech peak locations;

a3h) searching the second excitation waveform for third peaks including a third deviation factor, resulting in excitation peak locations; and a3i) assigning offsets to each of the excitation peak locations, resulting in the epoch locations.

5. The method as claimed in claim 1, wherein step b) comprises the steps of:

b1) computing epoch boundaries within the first excitation waveform;

b2) selecting a single epoch boundary, corresponding to a single epoch, from the epoch boundaries;

b3) computing a scalar mean of the single epoch;

b4) computing a scalar standard deviation of the single epoch;

b5) storing the scalar mean and the scalar standard deviation which comprise the scalar statistics; and b6) repeating steps b2) through b5) for additional epochs within the first excitation waveform.

6. The method as claimed in claim 5, wherein step b1) comprises the steps of:

b1a) estimating a second pitch using a first boundary index, a second boundary index, and a number of epochs of the first excitation waveform, wherein the first boundary index corresponds to a beginning sample location of the first excitation waveform, and the second boundary index corresponds to an ending sample location of the first excitation waveform;

b1b) setting an index pointer to the first boundary index;

b1c) incrementing the index pointer by the second pitch, producing a subsequent index pointer which defines a pitch normalized epoch location;

b1d) rounding the subsequent index pointer to a nearest integer;

b1e) storing the subsequent index pointer; and b1f) repeating steps b1c) through b1e) until all pitch normalized epoch locations have been estimated, wherein the pitch normalized epoch locations define the epoch boundaries.

7. The method as claimed in claim 1, wherein step b) comprises the steps of:

b1) computing the scalar statistics of the excitation waveform;

b2) energy normalizing pitch synchronous segments of the first excitation waveform using the scalar statistics, resulting in a second excitation waveform;

b3) computing ensemble statistics of the second excitation waveform, resulting in an ensemble mean and an ensemble standard deviation; and b4) normalizing the second excitation waveform by subtracting the ensemble mean and dividing by the ensemble standard deviation, resulting in a third excitation waveform, wherein step c) comprises the step of encoding the third excitation waveform and step d) comprises the step of creating the bitstream which includes an encoded version of the third excitation waveform.

8. The method as claimed in claim 7, wherein step b3) comprises the steps of:

b3a) computing epoch boundaries within the first excitation waveform;

b3b) loading a first epoch corresponding to a first epoch boundary from the second excitation waveform, wherein during a first iteration of steps b3d) through b3g), the first epoch is considered a previous epoch;

b3c) energy normalizing the first epoch;

b3d) loading a subsequent epoch corresponding to a subsequent epoch boundary from the second excitation waveform;

b3e) energy normalizing the subsequent epoch;

b3f) correlating the subsequent epoch with the previous epoch;

b3g) aligning the subsequent epoch using a correlation coefficient that corresponds to a maximum correlation offset determined in the correlating step;

b3h) repeating steps b3d) through b3g) until all epochs have been aligned, resulting in a set of aligned epochs;

b3i) computing the ensemble mean from the set of aligned epochs;

b3j) computing the ensemble standard deviation from the set of aligned epochs; and b3k) storing the ensemble mean and the ensemble standard deviation.

9. The method as claimed in claim 8, further comprising the steps of:

b3l) expanding the first epoch using interpolation after step b3b); and b3m) expanding the subsequent epoch using interpolation before step b3e).

10. The method as claimed in claim 8, wherein step b3a) comprises the steps of:

b3a1) estimating a second pitch using a first boundary index, a second boundary index, and a number of epochs of the first excitation waveform, wherein the first boundary index corresponds to a beginning sample location of the first excitation waveform, and the second boundary index corresponds to an ending sample location of the first excitation waveform;

b3a2) setting an index pointer to the first boundary index;

b3a3) incrementing the index pointer by the second pitch, producing a subsequent index pointer which defines a pitch normalized epoch location;

b3a4) rounding the subsequent index pointer to a nearest integer;

b3a5) storing the subsequent index pointer; and b3a6) repeating steps b3a3) through b3a5) until all pitch normalized epoch locations have been estimated, wherein the pitch normalized epoch locations define the epoch boundaries.

11. The method as claimed in claim 7, wherein step b4) comprises the steps of:

b4a) normalizing the first excitation waveform using a quantized scalar mean vector, resulting in a third excitation waveform;

b4b) normalizing the third excitation waveform using a quantized scalar standard deviation vector, resulting in a fourth excitation waveform;

b4c) selecting an epoch from the fourth excitation waveform;

b4d) computing an alignment offset from the epoch and a quantized ensemble mean;

b4e) aligning the epoch with the quantized ensemble mean corresponding to the alignment offset, resulting in an aligned epoch;

b4f) subtracting the quantized ensemble mean from the aligned epoch, resulting in a second epoch;

b4g) dividing the second epoch by a quantized ensemble standard deviation, resulting in a normalized epoch; and b4h) repeating steps b4c) through b4g) until all epochs of the first excitation waveform have been normalized, resulting in a normalized excitation waveform.

12. The method as claimed in claim 11, further comprising the step of:

b4i) pitch normalizing the epoch selected in step b4c), the quantized ensemble mean, and the quantized ensemble standard deviation.

13. The method as claimed in claim 1, wherein step c) comprises the steps of:

c1) determining whether a number of epochs within the first excitation waveform is greater than one;

c2) when the number of epochs is greater than one, upsampling a scalar statistic vector which describes the scalar statistics;

c3) selecting a codebook subset corresponding to a degree of periodicity of the speech waveform;

c4) encoding the scalar statistic vector using the codebook subset, resulting in one or more codebook indices and a quantized scalar statistic vector; and c5) repeating steps c1) through c4) until all scalar statistic vectors have been encoded.

14. The method as claimed in claim 13, further comprising the steps of:

c6) when the number of epochs is greater than one, downsampling the quantized scalar statistic vector; and c7) storing the quantized scalar statistic vector.

15. The method as claimed in claim 13, further comprising the step of calculating the degree of periodicity which comprises the steps of:

e) computing at least one feature which conveys the degree of periodicity of the input speech;

f) loading multi-layer perceptron (MLP) weights into memory;

g) computing an MLP output of a MLP classifier using the MLP weights and the at least one feature; and h) computing the degree of periodicity by scalar quantizing the MLP output.

16. The method as claimed in claim 1, wherein step c) comprises the steps of:

c1) determining whether a pitch of the input speech exceeds a characterization vector length;

c2) when the pitch exceeds the characterization vector length, downsampling an ensemble statistic vector which defines an ensemble statistic;

c3) performing a cyclic transform on the ensemble statistic vector, resulting in a cyclically transformed ensemble statistic vector, c4) performing a time-domain to frequency-domain transformation on the cyclically transformed ensemble statistic vector, resulting in a frequency-domain representation;

c5) selecting a codebook subset corresponding to a degree of periodicity of the speech waveform;

c6) encoding the frequency-domain representation using the codebook subset, resulting in codebook indices and a quantized frequency-domain representation; and c7) repeating steps c1) through c6) until all the ensemble statistics have been encoded.

17. The method as claimed in claim 16, further comprising the steps of:

c8) determining whether the ensemble statistic vector represents an ensemble standard deviation; and c9) when the ensemble statistic vector represents the ensemble standard deviation, computing a second ensemble standard deviation representing an envelope of the ensemble standard deviation.

18. The method as claimed in claim 16, further comprising the steps of:

c8) determining whether the ensemble statistic vector represents an ensemble standard deviation; and c9) when the ensemble statistic vector represents the ensemble standard deviation, computing a second ensemble standard deviation representing a filtered version of the ensemble standard deviation.

19. The method as claimed in claim 16, further comprising the steps of:

c8) performing a frequency-domain to time-domain transformation on the quantized frequency-domain representation, resulting in a quantized, cyclically-shifted, time-domain ensemble statistic vector, and c9) performing an inverse cyclic transform on the quantized, cyclically-shifted, time-domain ensemble statistic vector, resulting in a time-domain ensemble statistic vector.

20. The method as claimed in claim 1, wherein step c) comprises the steps of:

c1) determining whether a pitch of the input speech is greater than a characterization vector length;

c2) when the pitch is greater than the characterization vector length, downsampling an ensemble statistic vector which defines an ensemble statistic;

c3) when the pitch is less than the characterization vector length, upsampling the ensemble statistic vector, c4) selecting a codebook subset corresponding to a degree of periodicity of the speech waveform;

c5) encoding the ensemble statistic vector using the codebook subset, resulting in codebook indices and a quantized ensemble statistic vector; and c6) repeating steps c1) through c5) until all the ensemble statistics have been encoded.

21. The method as claimed in claim 20, wherein step c) further comprises the steps of:

c7) determining whether the ensemble statistic vector represents an ensemble standard deviation; and c8) when the ensemble statistic vector represents the ensemble standard deviation, computing a second ensemble standard deviation representing an envelope of the ensemble standard deviation.

22. The method as claimed in claim 20, further comprising the steps of:

c7) determining whether the ensemble statistic vector represents an ensemble standard deviation; and c8) when the ensemble statistic vector represents the ensemble standard deviation, computing a second ensemble standard deviation representing a filtered version of the ensemble standard deviation.

23. The method as claimed in claim 20, further comprising the steps of:

c7) when the pitch is greater than the characterization vector length, upsampling the quantized ensemble statistic vector; and c8) when the pitch is less than the characterization vector length, downsampling the quantized ensemble statistic vector.

24. The method as claimed in claim 1, wherein step c) comprises the steps of:

c1) filtering a normalized excitation waveform derived from the first excitation waveform, resulting in a normalized, filtered excitation waveform;

c2) downsampling the normalized, filtered excitation waveform, resulting in a characterized excitation waveform vector, c3) selecting a codebook subset based on a degree of periodicity of the speech waveform; and c4) encoding the characterized excitation waveform vector using the codebook subset.

25. The method as claimed in claim 1, wherein step c) comprises the steps of:

c1) pitch normalizing a normalized excitation waveform, resulting in a pitch normalized excitation waveform;

c2) filtering the pitch normalized excitation waveform, resulting in a filtered excitation waveform;

c3) performing a time-domain to frequency-domain transformation of the filtered excitation waveform, resulting in a frequency-domain representation;

c4) selecting a codebook subset based on a degree of periodicity of the speech waveform; and c5) encoding the frequency-domain representation using the codebook subset.

26. The method as claimed in claim 25, further comprising the steps, performed after step c2), of:

c6) performing a second LPC analysis on the filtered excitation waveform, resulting in spectral parameters;

c7) encoding the spectral parameters; and c8) inverse filtering the filtered excitation waveform using the spectral parameters, resulting in a second excitation waveform.

27. The method as claimed in claim 1, wherein step c) comprises the steps of:

c1) computing an ensemble alignment vector corresponding to an alignment between one or more epochs and a quantized ensemble mean, wherein the one or more epochs are portions of the first excitation waveform;

c2) when a number of the one or more epochs exceeds one, upsampling the ensemble alignment vector;

c3) selecting a codebook subset based on a degree of periodicity of the speech waveform; and c4) encoding the ensemble alignment vector using the codebook subset.

28. A method for synthesizing speech comprising the steps of:

a) decoding encoded scalar statistics and encoded ensemble statistics, resulting in scalar statistics and ensemble statistics which describe an excitation waveform;

b) decoding encoded spectral parameters, resulting in spectral parameters;

c) decoding an encoded, normalized excitation waveform, resulting in a normalized excitation waveform;

d) denormalizing the normalized excitation waveform using the scalar statistics and the ensemble statistics, resulting in a decoded excitation waveform; and e) synthesizing the speech from the decoded excitation waveform and the spectral parameters.

29. The method as claimed in claim 28, wherein step c) comprises the steps of:

c1) selecting a codebook subset based on a degree of periodicity of the speech;

c2) decoding the encoded, normalized excitation waveform using the codebook subset, resulting in a characterized, normalized excitation waveform vector; and c3) upsampling the characterized, normalized excitation waveform vector, resulting in the normalized excitation waveform.

30. The method as claimed in claim 29, wherein step c) further comprises the steps of:

c4) performing a time-domain to frequency-domain transformation on the normalized excitation waveform, resulting in a frequency-domain representation;

c5) performing a modulo-F cyclic repetition procedure on the frequency-domain representation, resulting in a second frequency-domain representation; and c6) performing a frequency-domain to time-domain transformation on the second frequency-domain representation, wherein a result is used as the normalized excitation waveform.

31. The method as claimed in claim 30, wherein step c5) comprises the steps of:

c5a) cyclically repeating an inphase component of the frequency-domain representation at a modulo-F interval, wherein F represents a characterization filter cutoff, resulting in contiguous successive inphase cycles;

c5b) alternately changing signs of the contiguous successive inphase cycles;

c5c) weighting the contiguous successive inphase cycles, resulting in weighted inphase cycles;

c5d) cyclically repeating a quadrature component of the frequency-domain representation at the modulo-F interval, wherein F represents the characterization filter cutoff, resulting in contiguous successive quadrature cycles;

c5e) alternately changing signs of the contiguous successive quadrature cycles; and c5f) weighting the contiguous successive quadrature cycles, resulting in weighted quadrature cycles, wherein the second frequency-domain representation comprises the weighted inphase cycles and the weighted quadrature cycles.

32. The method as claimed in claim 28, wherein step c) comprises the steps of:

c1) selecting a codebook subset based on a degree of periodicity of the speech;

c2) decoding a frequency-domain representation of the normalized excitation waveform;

c3) performing a frequency-domain to time-domain transformation of the frequency-domain representation, resulting in the normalized excitation waveform; and c4) denormalizing a pitch of the normalized excitation waveform.

33. The method as claimed in claim 32, further comprising the steps, performed after step c2), of:

c5) cyclically repeating an inphase component of the frequency-domain representation at a modulo-F interval, wherein F represents a characterization filter cutoff, resulting in contiguous successive inphase cycles;

c6) alternately changing signs of the contiguous successive inphase cycles;

c7) weighting the contiguous successive inphase cycles, resulting in weighted inphase cycles;

c8) cyclically repeating a quadrature component of the frequency-domain representation at the modulo-F interval, wherein F represents the characterization filter cutoff, resulting in contiguous successive quadrature cycles;

c9) alternately changing signs of the contiguous successive quadrature cycles; and c10) weighting the contiguous successive quadrature cycles, resulting in weighted quadrature cycles, wherein the frequency-domain representation comprises the weighted inphase cycles and the weighted quadrature cycles.

34. The method as claimed in claim 28, wherein step c) comprises the steps of:

c1) selecting a codebook subset based on a degree of periodicity of the speech;

c2) decoding a frequency-domain representation of the normalized excitation waveform using the codebook subset;

c3) performing a frequency-domain to time-domain transformation of the frequency-domain representation, resulting in a spectral model excitation;

c4) decoding spectral parameters derived from the normalized excitation waveform using the codebook subset;

c5) performing a prediction filter using the spectral parameters and the spectral model excitation, resulting in the normalized excitation waveform; and c6) denormalizing a pitch of the normalized excitation waveform.

35. The method as claimed in claim 34, wherein step c) further comprises the steps of:

c7) performing a time-domain to frequency-domain transformation on the normalized excitation waveform, resulting in a second frequency-domain representation;

c8) performing a modulo-F cyclic repetition procedure on the second frequency-domain representation, resulting in a third frequency-domain representation; and c9) performing a second frequency-domain to time-domain transformation on the third frequency-domain representation, wherein a result is used as the normalized excitation waveform.

36. The method as claimed in claim 28, wherein step a) comprises the steps of:

a1) selecting a codebook subset based on a degree of periodicity of the speech;

a2) decoding a frequency-domain representation of an encoded ensemble statistic using the codebook subset;

a3) performing a frequency-domain to time-domain transformation on the frequency-domain representation, resulting in a shifted, time-domain ensemble statistic;

a4) performing an inverse cyclic transform on the shifted, time-domain ensemble statistic, resulting in an ensemble statistic; and a5) repeating steps a1) through a4) until all the encoded ensemble statistics are decoded.

37. The method as claimed in claim 36, wherein step a) further comprises the step of:

a6) when a pitch of the ensemble statistic exceeds a characterization length, upsampling the ensemble statistic.

38. The method as claimed in claim 28, wherein step a) comprises the steps of:

a1) selecting a codebook subset based on a degree of periodicity of the speech;

a2) decoding a time-domain ensemble statistic vector using the codebook subset;

a3) when a pitch is greater than a characterization length, upsampling the time-domain ensemble statistic vector;

a4) when the pitch is less than the characterization length, downsampling the time-domain ensemble statistic vector, and a5) repeating steps a1) through a4) until all the encoded ensemble statistics have been decoded.

39. The method as claimed in claim 28, wherein step a) comprises the steps of:

a1) selecting a codebook subset based on a degree of periodicity of the speech;

a2) decoding a time-domain scalar statistic vector using the codebook subset;

a3) when a number of epochs in the encoded, normalized excitation waveform exceeds one, downsampling the time-domain scalar statistic vector; and a4) repeating steps a1) through a3) until all the encoded scalar statistics have been decoded.

40. The method as claimed in claim 28, wherein step d) comprises the steps of:

d1) selecting a codebook subset based on a degree of periodicity of the speech;

d2) decoding a characterized ensemble alignment vector using the codebook subset;

d3) when a number of epochs in the encoded, normalized excitation waveform exceeds one, downsampling the characterized ensemble alignment vector, resulting in an ensemble alignment vector, and d4) denormalizing the normalized excitation waveform using the ensemble alignment vector, the scalar statistics, and the ensemble statistics.

41. The method as claimed in claim 28, wherein step d) comprises the steps of:

d1) selecting an ensemble segment from the normalized excitation waveform;

d2) applying an ensemble standard deviation to the ensemble segment, resulting in a second ensemble segment;

d3) adding an ensemble mean to the second ensemble segment, resulting in a third ensemble segment;

d4) applying an alignment offset to the third ensemble segment, resulting in a denormalized excitation segment; and d5) repeating steps d1) through d4) until all segments have been denormalized, resulting in the decoded excitation waveform.

42. The method as claimed in claim 41, further comprising the step, performed after step d4), of:

d6) applying a weighting function to the denormalized excitation segment.

43. A method for encoding a speech waveform comprising the steps of:

a) computing scalar statistics and ensemble statistics of the speech waveform;

b) normalizing the speech waveform using the scalar statistics and the ensemble statistics, resulting in a normalized speech waveform;

c) encoding the scalar statistics, the ensemble statistics, and the normalized speech waveform; and d) creating a bitstream which includes encoded versions of the scalar statistics, the ensemble statistics, and the normalized speech waveform.

44. A method for synthesizing speech comprising the steps of:

a) decoding encoded scalar statistics and encoded ensemble statistics, resulting in scalar statistics and ensemble statistics which describe a speech waveform;

b) decoding an encoded, normalized speech waveform, resulting in a normalized speech waveform; and c) denormalizing the normalized speech waveform using the scalar statistics and the ensemble statistics, resulting in a decoded speech waveform.

45. A speech analysis apparatus comprising:

means for generating a first excitation waveform by performing a linear prediction coefficient (LPC) analysis on a number of samples of input speech and inverse filtering the samples of input speech;

means for computing scalar statistics and ensemble statistics of the first excitation waveform coupled to the means for generating the first excitation waveform;

means for encoding the scalar statistics and the ensemble statistics coupled to the means for computing; and means for creating a bitstream, coupled to the means for encoding, wherein the bitstream includes encoded versions of the scalar statistics and the ensemble statistics.

46. A speech synthesis apparatus comprising:

means for decoding encoded scalar statistics and encoded ensemble statistics, resulting in scalar statistics and ensemble statistics which describe an excitation waveform;

means for decoding encoded spectral parameters, resulting in spectral parameters, coupled to the means for decoding the encoded scalar statistics;

means for decoding an encoded, normalized excitation waveform, resulting in a normalized excitation waveform, coupled to the means for decoding the encoded spectral parameters;

means for denormalizing the normalized excitation waveform using the scalar statistics and the ensemble statistics, resulting in a decoded excitation waveform, coupled to the means for decoding the encoded, normalized excitation waveform; and means for synthesizing speech from the decoded excitation waveform and the spectral parameters, coupled to the means for denormalizing.

* * * * *